US010598417B2

(12) United States Patent
Ochiai et al.

(10) Patent No.: US 10,598,417 B2
(45) Date of Patent: Mar. 24, 2020

(54) REFRIGERATION CYCLE APPARATUS AND REFRIGERATION CYCLE APPARATUS ABNORMALITY DETECTING SYSTEM

(71) Applicant: Mitsubishi Electric Corporation, Tokyo (JP)

(72) Inventors: Yasutaka Ochiai, Tokyo (JP); Masaki Toyoshima, Tokyo (JP); Makoto Saito, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 79 days.

(21) Appl. No.: 15/554,253

(22) PCT Filed: Apr. 30, 2015

(86) PCT No.: PCT/JP2015/062980
§ 371 (c)(1),
(2) Date: Aug. 29, 2017

(87) PCT Pub. No.: WO2016/174767
PCT Pub. Date: Nov. 3, 2016

(65) Prior Publication Data

US 2018/0051922 A1 Feb. 22, 2018

(51) Int. Cl.
*F25B 49/02* (2006.01)
*F25B 49/00* (2006.01)
(Continued)

(52) U.S. Cl.
CPC ..... *F25B 49/02* (2013.01); *F25B 43/006* (2013.01); *F25B 49/005* (2013.01); *F25B 13/00* (2013.01);
(Continued)

(58) Field of Classification Search
CPC ..... F25B 2400/06; F25B 2400/075; F25B 2600/2501; F25B 2600/2517;
(Continued)

(56) References Cited

U.S. PATENT DOCUMENTS

2007/0156373 A1* 7/2007 Yamashita ..... F25B 49/005 702/182
2011/0308267 A1 12/2011 Tamaki et al.
(Continued)

FOREIGN PATENT DOCUMENTS

JP S61-083836 A 4/1986
JP 2002-005548 A 1/2002
(Continued)

OTHER PUBLICATIONS

International Search Report of the International Searching Authority dated Jul. 28, 2015 for the corresponding international application No. PCT/JP2015/062980 (and English translation).
(Continued)

*Primary Examiner* — Edward F Landrum
*Assistant Examiner* — Chang H. Park
(74) *Attorney, Agent, or Firm* — Posz Law Group, PLC

(57) ABSTRACT

A refrigeration cycle apparatus is provided with a compressor, a condenser, a pressure-reducing device, and an evaporator. The refrigeration cycle apparatus comprises a refrigeration cycle configured to circulate refrigerant; and a control unit configured to control the refrigeration cycle. The control unit causes the refrigeration cycle to operate when an operation condition is satisfied, the operation condition including elapse of a preset time after the control unit stops the refrigeration cycle. The control unit detects abnormality of the refrigeration cycle based on state data indicating a state of the refrigeration cycle after the control unit causes the refrigeration cycle to operate.

13 Claims, 16 Drawing Sheets

(51) Int. Cl.
*F25B 43/00* (2006.01)
*F25B 13/00* (2006.01)

(52) U.S. Cl.
CPC . *F25B 2313/0233* (2013.01); *F25B 2500/222* (2013.01); *F25B 2500/23* (2013.01); *F25B 2500/24* (2013.01); *F25B 2500/27* (2013.01); *F25B 2600/05* (2013.01); *F25B 2600/2513* (2013.01); *F25B 2700/04* (2013.01); *F25B 2700/151* (2013.01)

(58) Field of Classification Search
CPC ..... F25B 2700/193; F25B 2700/2116; F25B 41/04; F25B 41/043; F25B 5/02; F25B 6/02; F25B 2500/26; F25B 2500/27; F25B 2500/222; F25B 43/006; F25B 2700/04; F25B 2700/151

See application file for complete search history.

(56) References Cited

U.S. PATENT DOCUMENTS

2015/0052917 A1* 2/2015 Sugiyama ..... F25B 7/00 62/115
2015/0176880 A1* 6/2015 Ochiai ..... F25B 49/005 62/115

FOREIGN PATENT DOCUMENTS

| | | | | |
|---|---|---|---|---|
| JP | 2004-092976 | A | 3/2004 | |
| JP | 2006-023051 | A | 1/2006 | |
| JP | 2010-236714 | A | 10/2010 | |
| WO | 2014/017161 | A1 | 1/2014 | |
| WO | WO-2014017161 | A1 * | 1/2014 | ..... F25B 49/005 |
| WO | 2015/198489 | A1 | 12/2015 | |

OTHER PUBLICATIONS

Office Action dated Apr. 2, 2019 issued in corresponding JP patent application No. 2017-515348 (and English translation).

* cited by examiner

REFRIGERATION CYCLE APPARATUS AND REFRIGERATION CYCLE APPARATUS ABNORMALITY DETECTING SYSTEM

CROSS REFERENCE TO RELATED APPLICATION

This application is a U.S. national stage application of International Application No. PCT/JP2015/062980, filed on Apr. 30, 2015, the contents of which are incorporated herein by reference.

TECHNICAL FIELD

The present invention relates to a refrigeration cycle apparatus and a refrigeration cycle apparatus abnormality detecting system.

BACKGROUND

Patent Literature 1 describes a refrigeration cycle apparatus such as an air conditioning apparatus. In this refrigeration cycle apparatus, a refrigerant quantity for each element constituting the refrigerant circuit is demanded from the operation state quantities of each element, and a computed refrigerant quantity is computed as the total of these quantities. Also, by comparing the computed refrigerant quantity to a corrected refrigerant quantity acquired in advance, excess or insufficiency in refrigerant quantity is detected.

PATENT LITERATURE

Patent Literature 1: Japanese Unexamined Patent Application Publication No. 2010-236714

However, with the refrigeration cycle apparatus described in Patent Literature 1, since the computed refrigerant quantity is computed on the basis of the operation state quantities of each element of the refrigerant circuit, there is a problem in that excess or insufficiency in refrigerant quantity cannot be detected during periods in which the refrigeration cycle apparatus is stopped over a long period of time, such as in the middle of spring or autumn.

SUMMARY

The present invention has been made to overcome problems like the above, and an object of the present invention is to provide a refrigeration cycle apparatus and a refrigeration cycle apparatus abnormality detecting system capable of detecting abnormality even during periods in which the refrigeration cycle apparatus is stopped over a long period of time.

A refrigeration cycle apparatus of one embodiment of the present invention includes: a refrigeration cycle configured to circulate refrigerant; and a controller configured to control the refrigeration cycle, the controller being configured to cause the refrigeration cycle to operate when an operation condition is satisfied, the operation condition including elapse of a preset time after the refrigeration cycle stops, and detect abnormality of the refrigeration cycle based on state data indicating a state of the refrigeration cycle after the controller causes the refrigeration cycle to operate.

A refrigeration cycle apparatus abnormality detecting system of one embodiment of the present invention includes: a refrigeration cycle configured to circulate refrigerant; a control unit configured to control the refrigeration cycle; and an abnormality detecting device connected to the control unit via a communication network. The control unit causes the refrigeration cycle to operate when an operation condition is satisfied, the operation condition including elapse of a preset time after the refrigeration cycle stops. The control unit transmits state data indicating a state of the refrigeration cycle after the control unit causes the refrigeration cycle to operate to the abnormality detecting device. The abnormality detecting device detects abnormality of the refrigeration cycle based on the state data received from the control unit.

According to an embodiment of the present invention, an abnormality in the refrigeration cycle apparatus can be detected, even during periods in which the refrigeration cycle apparatus is stopped over a long period of time.

DETAILED DESCRIPTION

Embodiment 1

Figure 1:
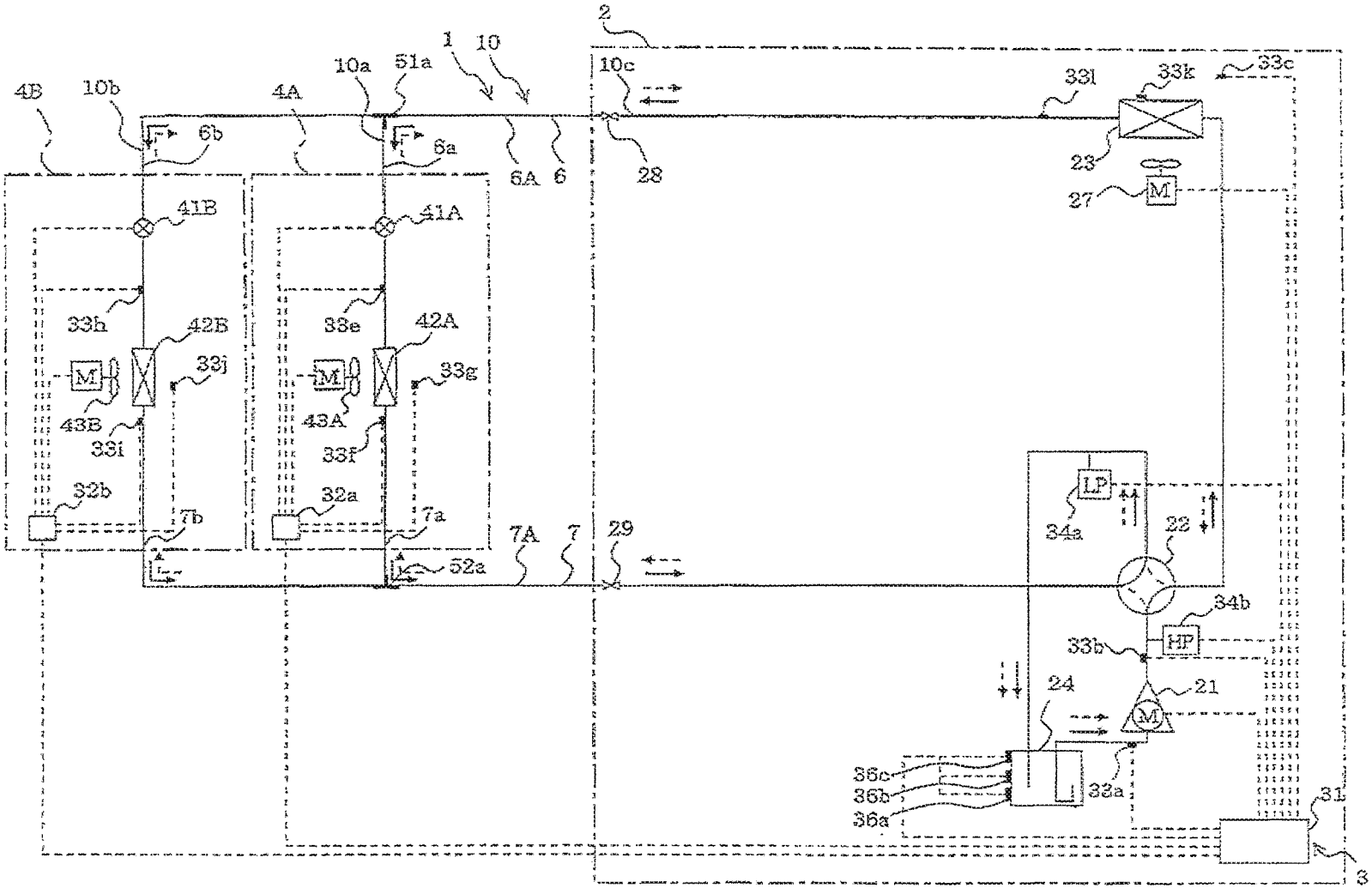
FIG. 1 is a refrigerant circuit diagram illustrating a schematic configuration of a refrigeration cycle apparatus according to Embodiment 1 of the present invention.

A refrigeration cycle apparatus according to Embodiment 1 of the present invention will be described. FIG. 1 is a refrigerant circuit diagram illustrating a schematic configuration of a refrigeration cycle apparatus according to Embodiment 1. Embodiment 1 illustrates an air conditioning apparatus 1 as an example of the refrigeration cycle apparatus. A refrigerant circuit configuration and operation of the air conditioning apparatus 1 will be described on the basis of FIG. 1. The air conditioning apparatus 1 is installed in a facility such as an office building or apartment building, for example, and by conducting a vapor compression-type refrigeration cycle operation, is used to cool and heat an air-conditioning target area such an indoor space where the air conditioning apparatus 1 is installed.

<Configuration of Air Conditioning Apparatus 1>

The air conditioning apparatus 1 mainly is provided with an outdoor unit 2 as a heat source unit, and indoor units 4 (indoor unit 4A, indoor unit 4B) as multiple (in FIG. 1, two units are illustrated) usage units which are connected to the outdoor unit 2 in parallel. Also, the air conditioning apparatus 1 includes refrigerant extension pipes (liquid-side extension pipes 6, gas-side extension pipes 7) that connect the outdoor unit 2 and the indoor units 4. In other words, the air conditioning apparatus 1 includes a refrigerant circuit 10 (refrigeration cycle) in which the outdoor unit 2 and the indoor units 4 are connected by refrigerant pipes, and through which refrigerant circulates.

The liquid-side extension pipes 6 are pipes through which liquid refrigerant flows, connecting the outdoor unit 2 and the indoor units 4. The liquid-side extension pipes 6 have a configuration in which a liquid main pipe 6A, a liquid branch pipe 6*a*, a liquid branch pipe 6*b*, and a distributor 51*a* are connected.

Meanwhile, the gas-side extension pipes 7 are pipes through which gas refrigerant flows, connecting the outdoor unit 2 and the indoor units 4. The gas-side extension pipes 7 have a configuration in which a gas main pipe 7A, a gas branch pipe 7*a*, a gas branch pipe 7*b*, and a distributor 52*a* are connected.

[Refrigerant]

For the refrigerant filling the refrigerant circuit 10, an azeotropic refrigerant for which the saturated gas temperature and the saturated liquid temperature are equal, or a near-azeotropic refrigerant for which the saturated gas temperature and the saturated liquid temperature are nearly equal (for example, R410A) can be used. Alternatively, for the refrigerant filling the refrigerant circuit 10, a non-azeotropic refrigerant (for example, a refrigerant mixture including R1123 as a base) may also be used. In other words, the refrigerant filling the refrigerant circuit 10 is not particularly limited.

[Indoor Units 4]

The indoor unit 4A and the indoor unit 4B receive a supply of cooling energy or heating energy from the outdoor unit 2, and supply cooled air or heated air to the air-conditioning target area. Note that in the following description, the letters "A" and "B" which come after the indoor units 4 may be omitted in some cases. In such cases, both the indoor unit 4A and the indoor unit 4B are taken to be denoted. Also, the letter "A" (or "a") is appended to the sign of each device (also including part of the circuit) in the "indoor unit 4A" subsystem, while the letter "B" (or "b") is appended to the sign of each device (also including part of the circuit) in the "indoor unit 4B" subsystem. In the descriptions of these, likewise, the letters "A" (or "a") and "B" (or "b") which come after the signs may be omitted in some cases. In such cases, both devices are denoted.

The indoor units 4 are installed by being embedded into the ceiling, hung from the ceiling, or hung on the wall of a room inside a building or the like. The indoor unit 4A is connected to the outdoor unit 2 using the liquid main pipe 6A, the distributor 51*a*, the liquid branch pipe 6*a*, the gas branch pipe 7*a*, the distributor 52*a*, and the gas main pipe 7A, and constitutes part of the refrigerant circuit 10. The indoor unit 4B is connected to the outdoor unit 2 using the liquid main pipe 6A, the distributor 51*a*, the liquid branch pipe 6*b*, the gas branch pipe 7*b*, the distributor 52*a*, and the gas main pipe 7A, and constitutes part of the refrigerant circuit 10.

The indoor units 4 mainly include an indoor-side refrigerant circuit constituting part of the refrigerant circuit 10 (an indoor-side refrigerant circuit 10*a* for the indoor unit 4A, and an indoor-side refrigerant circuit 10*b* for the indoor unit 4B). This indoor-side refrigerant circuit is configured mainly by an expansion valve 41 that acts as an expansion mechanism (one example of a pressure-reducing device) and an indoor heat exchanger 42 that acts as a use side heat exchanger, which are laid out in series.

The expansion valve 41 is installed on the liquid side of the indoor heat exchanger 42, depressurizing and expanding refrigerant to adjust the flow rate of refrigerant flowing through the indoor-side refrigerant circuit and the like. The expansion valve 41 has a variably controllable opening degree, and may be configured as an electronic linear expansion valve or the like, for example.

The indoor heat exchanger 42 functions as a refrigerant condenser (radiator) that heats indoor air during heating operation, and functions as a refrigerant evaporator that cools indoor air during cooling operation. In the indoor heat exchanger 42, heat is exchanged between a heat medium (such as air or water, for example) and refrigerant, and the refrigerant condenses and liquefies, or evaporates and gasifies. The indoor heat exchanger 42 is not particularly limited in form, and may be configured as a fin and tube heat exchanger with a cross-fin design made up of heat transfer tubes and a large number of fins, for example.

The indoor units 4 include an indoor fan 43 that acts as an air-sending device for supplying supply air to the room, the supply air being obtained after sucking indoor air into the indoor unit 4 and exchanging heat with refrigerant in the indoor heat exchanger 42. The indoor fan 43 is capable of varying the flow of air supplied to the indoor heat exchanger 42, and may be configured as a centrifugal fan or a multi-bladed fan driven by a DC fan motor, for example. However, the indoor heat exchanger 42 may also exchange heat between refrigerant and a heat medium other than air (such as water or brine, for example).

Also, the indoor units 4 are provided with various sensors. On the gas side of the indoor heat exchanger 42, there is provided a gas-side temperature sensor (gas-side temperature sensor 33*f* (built into the indoor unit 4A), gas-side temperature sensor 33*i* (built into the indoor unit 4B)) that detects the temperature of refrigerant (that is, the refrigerant temperature corresponding to the condensing temperature Tc during heating operation or the evaporating temperature Te during cooling operation). On the liquid side of the indoor heat exchanger 42, there is provided a liquid-side temperature sensor (liquid-side temperature sensor 33*e* (built into the indoor unit 4A), liquid-side temperature sensor 33*h* (built into the indoor unit 4B)) that detects the temperature Teo of refrigerant.

Also, on the indoor air suction port side of the indoor units 4, there is provided an indoor temperature sensor (indoor temperature sensor 33*g* (built into the indoor unit 4A), and an indoor temperature sensor 33*j* (built into the indoor unit 4B)) that detects the temperature of indoor air flowing into the indoor unit 4 (that is, the indoor temperature Tr).

The information sensed by these various sensors (temperature information) is sent to a control unit (indoor side control unit 32) described later that controls the operation of the respective devices built into the indoor units 4, and is used for operation control of the respective devices. Note that the liquid-side temperature sensors 33*e* and 33*h*, the gas-side temperature sensors 33*f* and 33*i*, and the indoor temperature sensors 33*g* and 33*j* are not particularly limited in type, and may be configured as thermistors or the like, for example. In other words, the air conditioning apparatus 1 is configured so that the temperature of refrigerant can be measured as required by respective temperature sensors depending on the operation state.

The indoor units 4 include an indoor side control unit 32 (32*a*, 32*b*) that controls the operation of the respective devices constituting the indoor units 4. The indoor side control unit 32 includes components such as a microcontroller and memory, which are provided to control the indoor units 4. The indoor side control unit 32 is able to exchange information such as control signals with remote controls (not illustrated) for individually controlling the indoor units 4, and exchange information such as control signals with the outdoor unit 2 (specifically, an outdoor side control unit 31) via a transmission line (or wirelessly). In other words, the indoor side control unit 32 cooperates with the outdoor side control unit 31 to function as a control unit 3 that conducts operation control of the air conditioning apparatus 1 as a whole (see FIG. 2).

[Outdoor Unit 2]

The outdoor unit 2 has a function of supplying cooling energy or heating energy to the indoor units 4. The outdoor unit 2 is installed on the outside of the building or the like, for example, is connected to the indoor units 4 by the liquid-side extension pipes 6 and the gas-side extension pipes 7, and constitutes part of the refrigerant circuit 10. In other words, refrigerant flowing out from the outdoor unit 2 and through the liquid main pipe 6A is split into the liquid branch pipe 6*a* and the liquid branch pipe 6*b* via the distributor 51*a*, and flows into each of the indoor unit 4A and the indoor unit 4B. Similarly, refrigerant flowing out from the outdoor unit 2 and through the gas main pipe 7A is split into the gas branch pipe 7*a* and the gas branch pipe 7*b* via the distributor 52*a*, and flows into each of the indoor unit 4A and the indoor unit 4B.

The outdoor unit 2 mainly includes an outdoor side refrigerant circuit 10*c* that constitutes part of the refrigerant circuit 10. The outdoor side refrigerant circuit 10*c* is configured mainly by a compressor 21, a four-way valve 22 that acts as a flow channel changer, an outdoor heat exchanger 23 that acts as a heat source side heat exchanger, a liquid accumulation container 24 (in this example, an accumulator), an opening and closing valve 28, and an opening and closing valve 29, which are laid out in series.

The compressor 21 sucks refrigerant, and compresses the refrigerant into a high temperature and high pressure state. The compressor 21 is capable of varying the operational capacity, and may be configured as a device such as a volumetric compressor driven by a motor whose frequency F is controlled by an inverter, for example. Note that although FIG. 1 illustrates a case in which there is one compressor 21 as an example, the configuration is not limited thereto, and two or more compressors 21 may also be provided and connected in parallel, depending on factors such as the number of connected indoor units 4.

The four-way valve 22 switches the direction of the flow of refrigerant during heating operation and the direction of the flow of heat source side refrigerant during cooling operation. During cooling operation, the four-way valve 22 is switched as indicated by the solid lines, thereby connecting the discharge side of the compressor 21 to the gas side of the outdoor heat exchanger 23 while also connecting the liquid accumulation container 24 to the gas main pipe 7A side. With this arrangement, the outdoor heat exchanger 23 functions as a condenser, while the indoor heat exchanger 42 functions as an evaporator. During heating operation, the four-way valve 22 is switched as indicated by the dashed lines, thereby connecting the discharge side of the compressor 21 to the gas main pipe 7A while also connecting the liquid accumulation container 24 to the gas side of the outdoor heat exchanger 23. With this arrangement, the indoor heat exchanger 42 functions as a condenser, while the outdoor heat exchanger 23 functions as an evaporator.

The outdoor heat exchanger 23 functions as an evaporator of refrigerant during heating operation, and as a condenser (radiator) of refrigerant during cooling operation. In the outdoor heat exchanger 23, heat is exchanged between a heat medium (such as air or water, for example) and refrigerant, and the refrigerant evaporates and gasifies, or condenses and liquefies. The outdoor heat exchanger 23 is not particularly limited in form, and may be configured as a fin and tube heat exchanger with a cross-fin design made up of heat transfer tubes and a large number of fins, for example. Note that the gas side of the outdoor heat exchanger 23 is connected to the four-way valve 22, while the liquid side is connected to the liquid main pipe 6A.

The outdoor unit 2 includes an outdoor fan 27 that acts as an air-sending device for exhausting air outdoors, the exhaust air being obtained after sucking outdoor air into the outdoor unit 2 and exchanging heat with refrigerant in the outdoor heat exchanger 23. The outdoor fan 27 is capable of varying the flow rate of air supplied to the outdoor heat exchanger 23, and may be configured as a propeller fan or the like driven by a motor made up of a DC fan motor, for example. However, the outdoor heat exchanger 23 may also exchange heat between refrigerant and a heat medium other than air (such as water or brine, for example).

The liquid accumulation container 24 is connected to the suction side of the compressor 21, and has a refrigerant accumulation function of accumulating excess refrigerant, and a gas-liquid separation function that retains liquid refrigerant produced temporarily when the operation state changes, to thereby prevent large amounts of liquid refrigerant from flowing into the compressor 21. The liquid accumulation container 24 is formed of a metal such as carbon steel. The liquid accumulation container 24 is a pressurized container designed and manufactured to have a compressive strength conforming to laws and regulations.

When detecting a leakage of refrigerant from the refrigerant circuit 10, it is necessary to detect the amount of liquid refrigerant accumulated inside the liquid accumulation container 24. It is possible to provide a transparent portion such as an observation window in part of the liquid accumulation container 24. However, in practice, most liquid accumulation containers 24 are opaque containers, and it is impossible to use light or the like that passes therethrough to measure the liquid level inside the liquid accumulation container 24 from the outside, or see through to the entire interior of the liquid accumulation container 24 by visual inspection. Also, even if an optically transparent observation window is attached to part of the liquid accumulation container 24, the liquid level inside the liquid accumulation container 24 is constantly fluctuating, and thus it is difficult to measure or monitor the accurate position of the refrigerant liquid level inside the liquid accumulation container 24 from such an observation window.

Installed in the liquid accumulation container 24 is a liquid level sensor 36 for detecting the amount of liquid refrigerant inside. A temperature sensor that senses the liquid level by measuring the surface temperature of the liquid accumulation container 24 can be applied as the liquid level sensor 36.

Note that for the liquid level sensor 36, an ultrasonic sensor which is installed on the outside of the liquid accumulation container 24 and which senses the liquid level can be applied. Also, a heating temperature method can be applied for the liquid level sensor 36, in which a sensor unit is installed on the surface of the container or inside the container, the sensor is heated, and the liquid level is sensed from the differences in the heat dissipation properties of a gas phase part and a liquid phase part. Furthermore, a float method can be applied for the liquid level sensor 36, in which a float part is installed inside the liquid accumulation container 24, and gas or liquid is distinguished from the behavior of the float. Still further, a weight method can be applied as the liquid level sensor 36, in which the weight of the container or a measured value that changes depending on the weight is used to sense the amount of liquid.

The opening and closing valve 28 and the opening and closing valve 29 are provided at the connection ports with devices or pipes (specifically, the liquid main pipe 6A and the gas main pipe 7A) external to the outdoor unit 2, and by opening and closing, switch between conducting and not conducting refrigerant.

Also, the outdoor unit 2 is provided with multiple pressure sensors and temperature sensors. For the pressure sensors, a suction pressure sensor 34*a* that detects the suction pressure Ps of the compressor 21 and a discharge pressure sensor 34*b* that detects the discharge pressure Pd of the compressor 21 are installed.

For the temperature sensors, a suction temperature sensor 33*a*, a discharge temperature sensor 33*b*, a heat exchanger temperature sensor 33*k*, a liquid-side temperature sensor 33*l*, and an outdoor temperature sensor 33*c* are installed.

The suction temperature sensor 33*a* is installed at a position between the liquid accumulation container 24 and the compressor 21, and detects the suction temperature Ts of the compressor 21.

The discharge temperature sensor 33*b* is provided on the discharge side of the compressor 21, and detects the discharge temperature Td of the compressor 21.

The heat exchanger temperature sensor 33*k* is provided in the outdoor heat exchanger 23, and detects the temperature of refrigerant flowing inside the outdoor heat exchanger 23.

The liquid-side temperature sensor 33*l* is installed on the liquid side of the outdoor heat exchanger 23, and detects the refrigerant temperature on the liquid side of the outdoor heat exchanger 23.

The outdoor temperature sensor 33*c* is installed on the outdoor air suction port side of the outdoor unit 2, and detects the temperature of outdoor air flowing into the outdoor unit 2.

The information detected by these various sensors (temperature information) is sent to a control unit (outdoor side control unit 31) that controls the operation of the respective devices built into the outdoor unit 2, and is used for operation control of the respective devices. Note that each temperature sensor is not particularly limited in type, and may be configured as a thermistor or the like, for example.

The outdoor unit 2 includes an outdoor side control unit 31 that controls the operation of each element constituting the outdoor unit 2. The outdoor side control unit 31 includes components such as a microcontroller and memory provided to control the outdoor unit 2, and an inverter circuit that controls the motor. The outdoor side control unit 31 is able to exchange information such as control signals with the indoor side control units 32 of the indoor units 4 via a transmission line (or wirelessly). In other words, the outdoor side control unit 31 cooperates with the indoor side control units 32 to function as a control unit 3 that conducts operation control of the air conditioning apparatus 1 as a whole (see FIG. 2).

(Extension Pipes)

The extension pipes (liquid-side extension pipes 6, gas-side extension pipes 7) are pipes that connect the outdoor unit 2 and the indoor units 4, and are required to circulate refrigerant through the refrigerant circuit of the air conditioning apparatus 1.

The extension pipes are made up of liquid-side extension pipes 6 (liquid main pipe 6A, liquid branch pipes 6*a* and 6*b*) and gas-side extension pipes 7 (gas main pipe 7A, gas branch pipes 7*a* and 7*b*), and are refrigerant pipes laid out at the site when installing the air conditioning apparatus 1 at an installation location such as a building. Extension pipes of a pipe diameter determined in accordance with the combination of the outdoor unit 2 and the indoor units 4 are used for the extension pipes.

In Embodiment 1, as illustrated in FIG. 1, a distributor 51*a*, a distributor 52*a*, and extension pipes are used to connect one outdoor unit 2 to two indoor units 4A and 4B. Regarding the liquid-side extension pipes 6, the liquid main pipe 6A is connected between the outdoor unit 2 and the distributor 51*a*, while the liquid branch pipe 6*a* and the liquid branch pipe 6*b* connect between the distributor 51*a* and each of the indoor unit 4A and the indoor unit 4B, respectively. Regarding the gas-side extension pipes 7, the gas branch pipe 7*a* and the gas branch pipe 7*b* connect between each of the indoor unit 4A and the indoor unit 4B, and the distributor 52*a*, respectively, while the gas main pipe 7A connects between the distributor 52*a* and the outdoor unit 2.

Note that in Embodiment 1, extension pipes with the addition of the distributor 51*a* and the distributor 52*a* are used to connect one outdoor unit 2 to two indoor units 4, but the distributor 51*a* and the distributor 52*a* are not necessarily required. Also, although a case of using T pipes is illustrated as an example, the distributor 51*a* and the distributor 52*a* are not limited thereto, and headers may also be used. Also, if three or more indoor units 4 are connected, multiple T pipes may be used for distribution, or headers may be used.

As above, the indoor-side refrigerant circuit 10*a* and the indoor-side refrigerant circuit 10*b*, the outdoor side refrigerant circuit 10*c*, and the extension pipes (the liquid-side extension pipes 6 and the gas-side extension pipes 7) are connected to form the refrigerant circuit 10. The air conditioning apparatus 1 runs while switching between cooling operation and heating operation under control by the control unit 3 made up of the indoor side control unit 32*a*, the indoor side control unit 32*b*, and the outdoor side control unit 31. Also, the air conditioning apparatus 1 controls the respective devices of the outdoor unit 2, the indoor unit 4A, and the indoor unit 4B in accordance with the running load on each of the indoor unit 4A and the indoor unit 4B.

<Control Block Configuration of Air Conditioning Apparatus 1>

Figure 2:
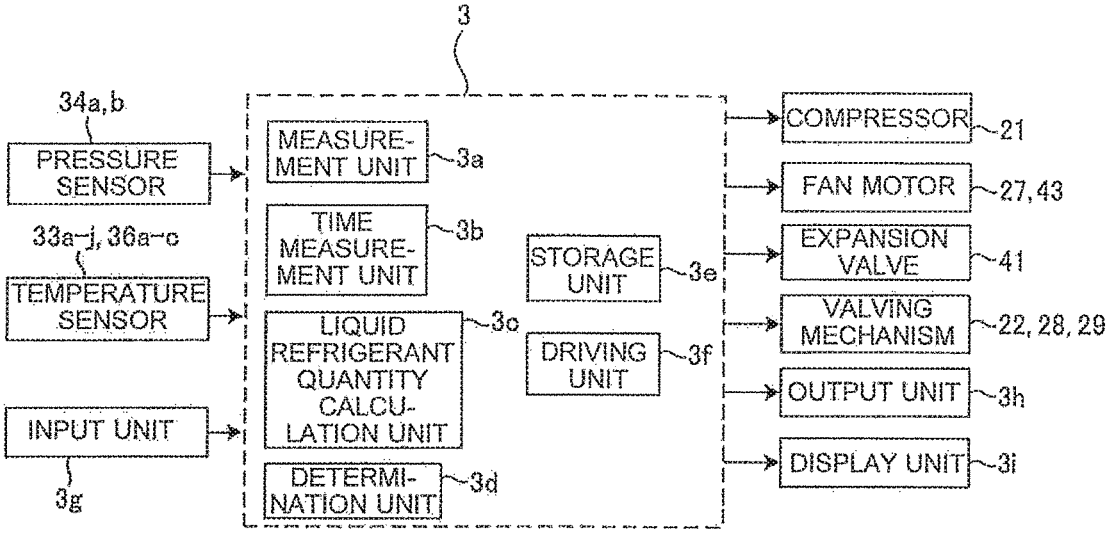
FIG. 2 is a control block diagram illustrating control blocks of a refrigeration cycle apparatus according to Embodiment 1 of the present invention.

FIG. 2 is a control block diagram illustrating control blocks of a refrigeration cycle apparatus according to Embodiment 1. The air conditioning apparatus 1 is provided with a liquid level detecting apparatus that detects the liquid level of the liquid accumulation container 24, and a refrigerant leakage detecting apparatus that detects refrigerant leakage inside the refrigerant circuit 10. FIG. 2 illustrates a block diagram of the expanded state of the functional configuration of the liquid level detecting apparatus and the refrigerant leakage detecting apparatus.

The control unit 3 is able to accept the input of detection signals from pressure sensors (suction pressure sensor 34*a*, discharge pressure sensor 34*b*) and temperature sensors (liquid-side temperature sensors 33*e* and 33*h*, gas-side temperature sensors 33*f* and 33*i*, indoor temperature sensors 33*g* and 33*j*, suction temperature sensor 33*a*, discharge temperature sensor 33*b*, heat exchanger temperature sensor 33*k*, liquid-side temperature sensor 33*l*, outdoor temperature sensor 33*c*). Also, on the basis of information such as these detection signals, the control unit 3 is able to control various devices (compressor 21, outdoor fan 27, indoor fan 43, valve apparatuses (four-way valve 22, flow control valves (opening and closing valve 28, opening and closing valve 29, expansion valve 41))). Furthermore, the control unit 3 is able to accept the input of detection signals from liquid level sensors 36*a*, 36*b*, and 36*c* installed in the liquid accumulation container 24.

Also, the control unit 3 is provided with a measurement unit 3*a*, a time measurement unit 3*b*, a liquid refrigerant quantity calculation unit 3*c*, a determination unit 3*d*, a storage unit 3*e*, and a driving unit 3*f*. Also connected to the control unit 3 are an input unit 3*g*, an output unit 3*h*, and a display unit 3*i*.

The measurement unit 3*a* includes a function that measures the pressure and temperature (in other words, operation state quantities) of refrigerant circulating through the refrigerant circuit 10, on the basis of information sent from the pressure sensors and the temperature sensors. Also, the measurement unit 3*a* constitutes a measurement unit together with pressure sensors and temperature sensors.

The time measurement unit 3*b* has a function of measuring the running time after the refrigeration cycle (for example, the compressor 21) is caused to operate, and the stopped time after the refrigeration cycle is stopped.

The liquid refrigerant quantity calculation unit 3*c* has a function of detecting the liquid level position of the liquid accumulation container 24, on the basis of detection signals from components such as the liquid level sensors 36*a* to 36*c*, the suction pressure sensor 34*a*, and the discharge pressure sensor 34*b*. Also, the liquid refrigerant quantity calculation unit 3*c* has a function of calculating the quantity of liquid refrigerant in the liquid accumulation container 24 from the sensed liquid level position, on the basis of a relational expression between the liquid level position and the liquid quantity stored in the storage unit 3*e*.

The determination unit 3*d* has a function of determining whether or not a refrigerant leakage exists, on the basis of the calculated result from the liquid refrigerant quantity calculation unit 3*c*. Additionally, in the case in which a refrigerant leakage is determined to exist, the determination unit 3*d* additionally is able to calculate the refrigerant leakage quantity by taking the difference between an initial refrigerant quantity and the calculated refrigerant quantity.

The storage unit 3*e* has the functions of storing values measured by the measurement unit 3*a*, storing values calculated by the liquid refrigerant quantity calculation unit 3*c*, storing internal volume data described later and an initial refrigerant quantity, storing information from the outside, and storing a relational expression described later that is used when calculating the liquid refrigerant quantity.

The driving unit 3*f* has a function of controlling the driving of each element driven in the air conditioning apparatus 1 (specifically, a compressor motor (compressor 21), valving mechanisms (four-way valve 22, flow control valves (opening and closing valve 28, opening and closing valve 29, expansion valve 41)), fan motors (outdoor fan 27, indoor fan 43), and the like), on the basis of information such as information measured by the measurement unit 3*a*.

The input unit 3*g* has a function of inputting and modifying set values for various types of controls. The input unit 3*g* may be configured as one or a combination of a remote control, an operation panel, and operation switches enabling operation by a user or worker, for example. For example, an operation panel and operation switches may be provided on the outdoor unit 2 or the indoor units 4A and 4B of the air conditioning apparatus 1, or may be provided in a remote management center.

The output unit 3*h* has a function of externally outputting information such as measurement values measured by the measurement unit 3*a*, and determination results by the determination unit 3*d*. The output unit 3*h* may also function as a communication unit for communicating with an external apparatus over a medium such as a phone line, a LAN connection, or wireless communication. By this arrangement, the air conditioning apparatus 1 becomes able to transmit information such as refrigerant leakage existence data indicating a refrigerant leakage determination result to a location such as a distant management center via a medium such as a communication line. With this arrangement, it is possible to add on a remote monitoring function that continuously detects abnormalities at a remote management center, and immediately performs maintenance if an abnormality occurs.

The display unit 3*i* has a function of displaying information such as measurement values measured by the measurement unit 3*a*, determination results by the determination unit 3*d*, or the operation state of the air conditioning apparatus 1. The display unit 3*i* is made up of a device such as an LED or a monitor visible from the outside. The display unit 3*i* may be provided in the air conditioning apparatus 1, and may also be provided in a remote management center.

The measurement unit 3*a* and the liquid refrigerant quantity calculation unit 3*c* constitute the liquid level detecting apparatus. Also, the measurement unit 3*a*, the liquid refrigerant quantity calculation unit 3*c*, the determination unit 3*d* and the storage unit 3*e*, and the output unit 3*h* or the display unit 3*i* constitute the refrigerant leakage detecting apparatus. Note although Embodiment 1 takes a configuration in which the liquid level detecting apparatus and the refrigerant leakage detecting apparatus are built into the air conditioning apparatus 1, the configuration is not limited thereto, and each apparatus may also take a separate configuration independent from the air conditioning apparatus 1.

<Operation of Air Conditioning Apparatus 1>

Next, the operation of each element during normal operation of the air conditioning apparatus 1 will be described.

The air conditioning apparatus 1 controls the respective component devices of the outdoor unit 2 and the indoor units 4A and 4B in accordance with the running load on each of the indoor units 4A and 4B, and thereby conducts cooling operation and heating operation.

(Cooling Operation)

Figure 3:
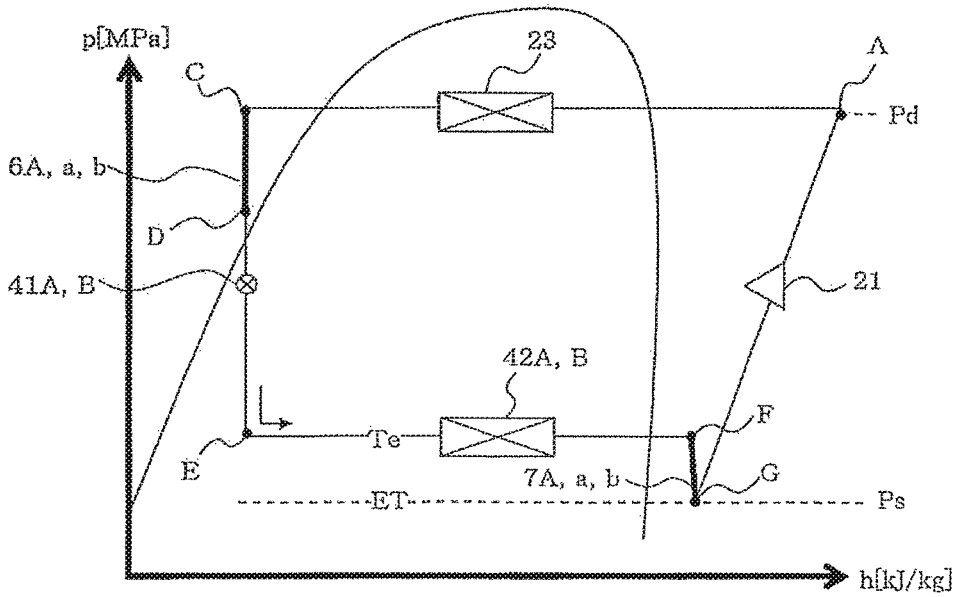
FIG. 3 is a p-h diagram illustrating the state of refrigerant during cooling operation of a refrigeration cycle apparatus according to Embodiment 1 of the present invention.

Cooling operation executed by the air conditioning apparatus 1 will be described using FIGS. 1 and 3. FIG. 3 is a p-h diagram illustrating the state of refrigerant during cooling operation of a refrigeration cycle apparatus according to Embodiment 1. Note that in FIG. 1, the flow of refrigerant during cooling operation is indicated by the solid arrows.

During cooling operation, the four-way valve 22 is controlled to create the state indicated by the solid lines in FIG. 1, namely, the state in which the discharge side of the compressor 21 is connected to the gas side of the outdoor heat exchanger 23, and the suction side of the compressor 21 is connected to the gas side of the indoor heat exchangers 42A and 42B via the opening and closing valve 29 and the gas-side extension pipes 7 (gas main pipe 7A, gas branch pipes 7*a* and 7*b*). Note that the opening and closing valve 28 and the opening and closing valve 29 are set to the open state. Also, in FIG. 1, a case in which cooling operation is executed by all indoor units 4 is described as an example.

Low temperature and low pressure refrigerant is compressed by the compressor 21 to become high temperature and high pressure gas refrigerant, and is discharged (point "A" illustrated in FIG. 3). The high temperature and high pressure gas refrigerant discharged from the compressor 21 flows, via the four-way valve 22, into the outdoor heat exchanger 23 that functions as a condenser. The refrigerant flowing into the outdoor heat exchanger 23 condenses and liquefies while transferring heat to outdoor air due to the air-sending action of the outdoor fan 27 (point "C" illustrated in FIG. 3). The condensing temperature at this point is measured by the liquid-side temperature sensor 33*l*, or is computed by converting the pressure detected by the discharge pressure sensor 34*b* into a saturation temperature.

After that, high pressure liquid refrigerant flowing out from the outdoor heat exchanger 23 flows out from the outdoor unit 2 via the opening and closing valve 28. The high pressure liquid refrigerant flowing out from the outdoor unit 2 drops in pressure due to pipe wall friction when passing through the liquid main pipe 6A, the liquid branch pipe 6*a*, and the liquid branch pipe 6*b* (point "D" illustrated in FIG. 3). This refrigerant flows into the indoor units 4A and 4B, and is depressurized by the expansion valves 41A and 41B to become low pressure two-phase gas-liquid refrigerant (point "E" illustrated in FIG. 3). This two-phase gas-liquid refrigerant flows into the indoor heat exchangers 42A and 42B that function as evaporators. In the indoor heat exchangers 42A and 42B, the two-phase gas-liquid refrigerant evaporates and gasifies by taking away heat from air due to the air-sending action of the indoor fans 43A and 43B (point "F" illustrated in FIG. 3). At this point, cooling of the air-conditioning target area is executed.

The evaporating temperature at this point is measured by the liquid-side temperature sensor 33*e* and the liquid-side temperature sensor 33*h*. The degree of superheat SH of refrigerant at the outlet port of the indoor heat exchangers 42A and 42B is computed by subtracting the temperature of the two-phase gas-liquid refrigerant detected by the liquid-side temperature sensor 33*e* and the liquid-side temperature sensor 33*h* from the temperature of the gas-phase refrigerant detected by the gas-side temperature sensor 33*f* and the gas-side temperature sensor 33*i*.

Also, during cooling operation, the opening degree of the expansion valves 41A and 41B is adjusted to make the degree of superheat SH of refrigerant at the outlet ports of the indoor heat exchangers 42A and 42B (that is, the gas side of the indoor heat exchangers 42A and 42B) reach a degree of superheat target value SHm.

Gas refrigerant passing through the indoor heat exchangers 42A and 42B (point "F" illustrated in FIG. 3) flows out from the indoor units 4A and 4B, passes through the gas-side extension pipes 7, namely the gas branch pipe 7*a* and the gas branch pipe 7*b*, the gas main pipe 7A, and the opening and closing valve 29, and flows into the outdoor unit 2. Gas refrigerant flowing out from the indoor units 4A and 4B drops in pressure due to pipe wall friction when passing through the gas branch pipe 7*a*, the gas branch pipe 7*b*, and the gas main pipe 7A (point "G" illustrated in FIG. 3). Refrigerant flowing into the outdoor unit 2 passes through the four-way valve 22 and the liquid accumulation container 24, and is suctioned into the compressor 21 again. By continuously repeating the above flow, cooling operation is executed.

(Heating Operation)

Figure 4:
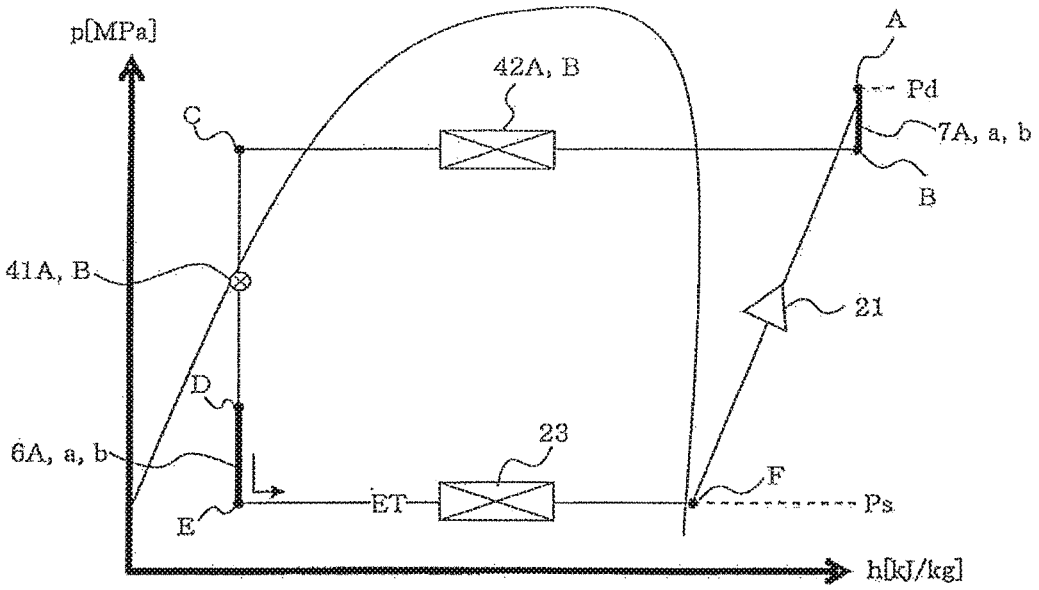
FIG. 4 is a p-h diagram illustrating the state of refrigerant during heating operation of a refrigeration cycle apparatus according to Embodiment 1 of the present invention.

Heating operation executed by the air conditioning apparatus 1 will be described using FIGS. 1 and 4. FIG. 4 is a p-h diagram illustrating the state of refrigerant during heating operation of a refrigeration cycle apparatus according to Embodiment 1. Note that in FIG. 1, the flow of refrigerant during heating operation is indicated by the dashed arrows.

During heating operation, the four-way valve 22 is controlled to create the state indicated by the dashed lines in FIG. 1, namely, the state in which the discharge side of the compressor 21 is connected to the gas side of the indoor heat exchangers 42A and 42B via the opening and closing valve 29 and the gas-side extension pipes 7 (gas main pipe 7A, gas branch pipes 7*a* and 7*b*), and the suction side of the compressor 21 is connected to the gas side of the outdoor heat exchanger 23. Note that the opening and closing valve 28 and the opening and closing valve 29 are set to the open state. Also, in FIG. 1, a case in which heating operation is executed by all indoor units 4 is described as an example.

Low temperature and low pressure refrigerant is compressed by the compressor 21 to become high temperature and high pressure gas refrigerant, and is discharged (point "A" illustrated in FIG. 4). The high temperature and high pressure gas refrigerant discharged from the compressor 21 passes through the gas-side extension pipes 7, and flows out from the outdoor unit 2 via the four-way valve 22 and the opening and closing valve 29. The high temperature and high pressure gas refrigerant flowing out from the outdoor unit 2 drops in pressure due to pipe wall friction when passing through the gas main pipe 7A, the gas branch pipe 7*a*, and the gas branch pipe 7*b* (point "B" illustrated in FIG. 4). This refrigerant flows into the indoor heat exchangers 42A and 42B of the indoor units 4A and 4B. The refrigerant flowing into the indoor heat exchangers 42A and 42B condenses and liquefies while transferring heat to indoor air due to the air-sending action of the indoor fans 43A and 43B (point "C" illustrated in FIG. 4). At this point, heating of the air-conditioning target area is executed.

The refrigerant flowing out from the indoor heat exchangers 42A and 42B is depressurized by the expansion valves 41A and 41B to become low pressure two-phase gas-liquid refrigerant (point "D" illustrated in FIG. 4). At this point, the opening degree of the expansion valves 41A and 41B is adjusted to make the degree of subcooling SC of refrigerant at the outlet ports of the indoor heat exchangers 42A and 42B reach a degree of subcooling target value SCm.

The degree of subcooling target value SCm is set to a large value in the case of a small temperature difference between the indoor set temperature and the indoor temperature, and is set to a small value in the case of a large temperature difference between the indoor set temperature and the indoor temperature. This is to adjust the capacity of the indoor units 4A and 4B by changing the setting of the degree of subcooling target value SCm. If the degree of subcooling target value SCm is large, the expansion valves 41A and 41B operate in the direction of decreasing the opening degree to increase the degree of subcooling SC, and thus the amount of circulated refrigerant decreases, and capacity is reduced. In contrast, if the degree of subcooling target value SCm is small, the expansion valves 41A and 41B operate in the direction of increasing the opening degree to decrease the degree of subcooling SC, and thus the amount of circulated refrigerant increases and the indoor heat exchangers 42A and 42B can be used effectively, thereby raising the heat exchange capacity.

The degree of subcooling SC of refrigerant at the outlet ports of the indoor heat exchangers 42A and 42B is computed by converting the discharge pressure Pd of the compressor 21 detected by the discharge pressure sensor 34*b* to a saturation temperature corresponding to the condensing temperature Tc, and respectively subtracting the refrigerant temperature detected by the liquid-side temperature sensors 33*e* and 33*h* from this refrigerant saturation temperature. Note that the degree of subcooling SC of refrigerant at the outlet ports of the indoor heat exchangers 42A and 42B may also be computed by providing separate temperature sensors that detect the temperature of refrigerant flowing inside the indoor heat exchangers 42A and 42B, and subtracting the refrigerant temperatures corresponding to the condensing temperature Tc detected by these temperature sensors from the refrigerant temperatures detected by the liquid-side temperature sensor 33*e* and the liquid-side temperature sensor 33*h*.

After that, low pressure two-phase gas-liquid refrigerant flows out from the indoor units 4A and 4B, passes through the liquid-side extension pipes 6, namely the liquid main pipe 6A, the liquid branch pipe 6*a* and the liquid branch pipe 6*b*, and the opening and closing valve 28, and flows into the outdoor unit 2. The two-phase gas-liquid refrigerant flowing out from the indoor units 4A and 4B drops in pressure due to pipe wall friction when passing through the liquid main pipe 6A, the liquid branch pipe 6*a*, and the liquid branch pipe 6*b* (point "E" illustrated in FIG. 4). The refrigerant flowing into the outdoor unit 2 flows into the outdoor heat exchanger 23, and evaporates and gasifies by taking away heat from outdoor air due to the air-sending action of the outdoor fan 27 (point "F" illustrated in FIG. 4). This refrigerant passes through the four-way valve 22 and the liquid accumulation container 24, and is suctioned into the compressor 21 again. By continuously repeating the above flow, heating operation is executed.

<Refrigerant Quantity of Air Conditioning Apparatus 1>

Next, the refrigerant quantity of the air conditioning apparatus 1 will be described in detail.

For each component device of the refrigerant circuit 10 of the air conditioning apparatus 1 to exhibit certain performance, a refrigerant quantity suited to the internal volume of each component device is required, and if the internal volumes of the indoor units 4A and 4B or the lengths of the extension pipes are different, the refrigerant quantity required by the refrigerant circuit 10 as a whole also becomes different. Thus, after configuring the refrigerant circuit 10 at the site where the air conditioning apparatus 1 is installed, the refrigerant circuit 10 is filled with the required quantity of refrigerant.

Also, the refrigerant quantity required by the refrigerant circuit 10 is also different depending on the state of the refrigerant circuit 10. In other words, the state of the refrigerant circuit 10 differs depending on the cooling or heating operation state and the surrounding environment such as the outdoor temperature and the indoor temperature, and the refrigerant quantity required by the refrigerant circuit 10 also changes accordingly. For this reason, ordinarily, when filling a refrigerant circuit with refrigerant, the refrigerant circuit is filled with refrigerant to match a operation state that requires a greater refrigerant quantity. Thus, during a operation state that does not require a great quantity of refrigerant, excess liquid refrigerant is accumulated in the liquid accumulation container 24.

Cooling operation requires a greater refrigerant quantity in the refrigerant circuit 10 than in the heating operation. This is because the expansion valves 41A and 41B are provided on the side of the indoor units 4A and 4B, and thus during cooling operation, the state of refrigerant in the extension pipes is liquid phase inside the liquid-side extension pipes 6 and gas phase inside the gas-side extension pipes 7 during cooling operation, but during heating operation the state of refrigerant is two-phase inside the liquid-side extension pipes 6 and gas phase inside the gas-side extension pipes 7. In other words, the refrigerant inside the liquid-side extension pipes 6 is in a liquid-phase state during cooling operation, and in a two-phase state during heating operation. Since the density of refrigerant is higher in the liquid-phase state than in the two-phase state, cooling operation requires a greater refrigerant quantity.

Also, differences in internal volume between the condenser and the evaporator, and differences in density between the condensation density and the evaporation density also greatly affect the required refrigerant quantity. Normally, the internal volume of the outdoor heat exchanger 23 is larger than the indoor heat exchangers 42A and 42B, and in addition, the average density of refrigerant inside the condenser is large compared to that inside the evaporator. Thus, during cooling operation, since the outdoor heat exchanger 23 with a large internal volume becomes a condenser with a large average density, a greater refrigerant quantity becomes required compared to during heating operation.

From the above, in the case of switching the four-way valve 22 to conduct cooling operation or heating operation, the refrigerant quantity required for cooling operation and heating operation becomes different. In such a case, the refrigerant circuit is filled with refrigerant to match the operation state requiring a great refrigerant quantity, and during the operation state that does not require a great quantity of refrigerant, excess liquid refrigerant is accumulated in components such as the liquid accumulation container 24.

[Explanation of Phenomenon of Refrigerant Accumulating in Liquid Accumulation Container 24]

The phenomenon in which refrigerant is accumulated in the low pressure liquid accumulation container 24 after a certain time elapses since the stopping of the air conditioning apparatus 1 will be described, taking cooling operation as an example. Changes in the refrigerant quantity in each element after the air conditioning apparatus 1 stops are illustrated in FIGS. 5 to 9. FIGS. 5 to 9 jointly illustrate the case of "ordinary refrigerant quantity", in which the normal quantity of refrigerant is contained (lines a1 to a5), and the case of "refrigerant leakage 30%", in which the refrigerant quantity is 30% less than the normal quantity (lines b1 to b5).

Figure 5:
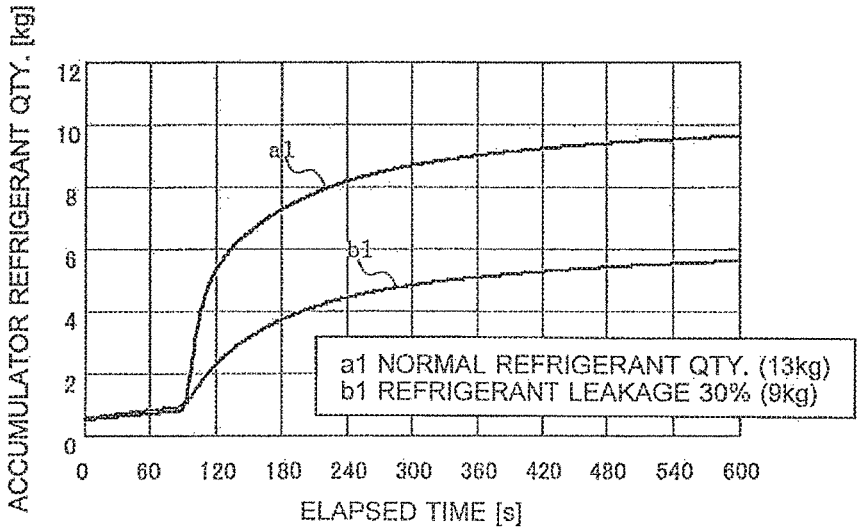
FIG. 5 is a graph illustrating change in refrigerant quantity inside a liquid accumulation container 24 with respect to elapsed time since the stopping of a compressor 21 in a refrigeration cycle apparatus according to Embodiment 1 of the present invention.
Figure 6:
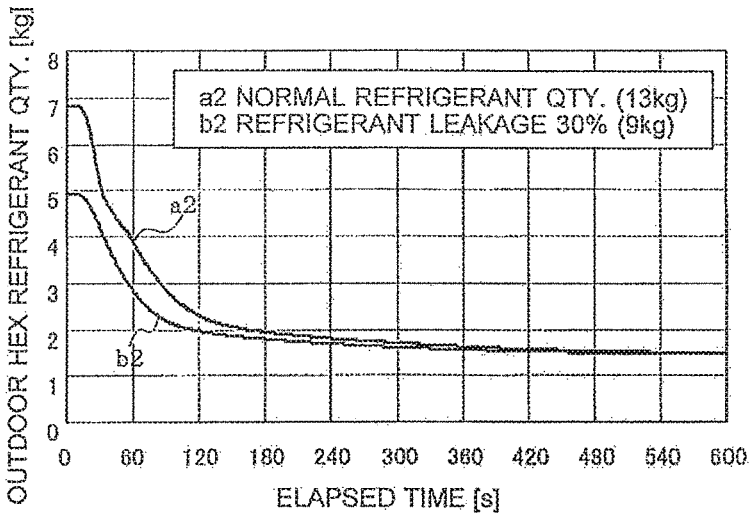
FIG. 6 is a graph illustrating change in refrigerant quantity inside an outdoor heat exchanger 23 with respect to elapsed time since the stopping of a compressor 21 in a refrigeration cycle apparatus according to Embodiment 1 of the present invention.
Figure 7:
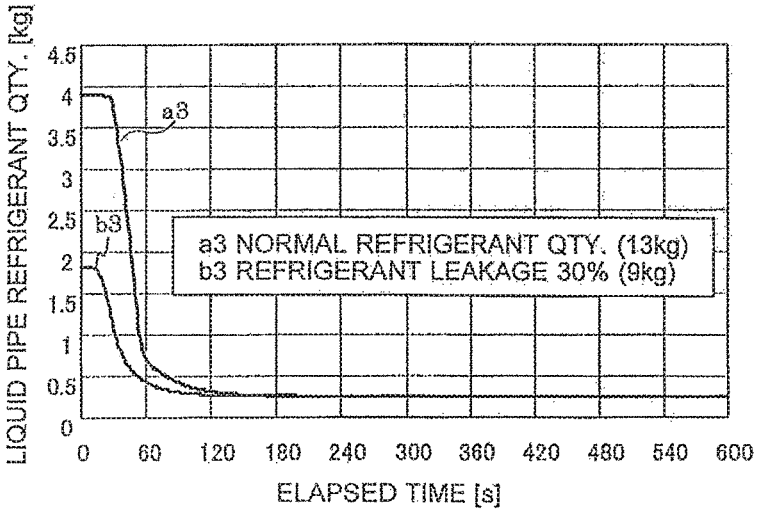
FIG. 7 is a graph illustrating change in refrigerant quantity inside liquid-side extension pipes 6 with respect to elapsed time since the stopping of a compressor 21 in a refrigeration cycle apparatus according to Embodiment 1 of the present invention.
Figure 8:
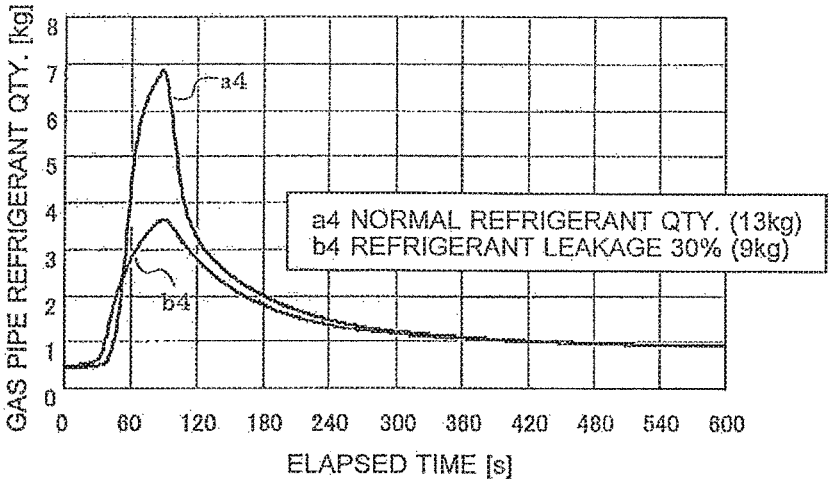
FIG. 8 is a graph illustrating change in refrigerant quantity inside gas-side extension pipes 7 with respect to elapsed time since the stopping of a compressor 21 in a refrigeration cycle apparatus according to Embodiment 1 of the present invention.
Figure 9:
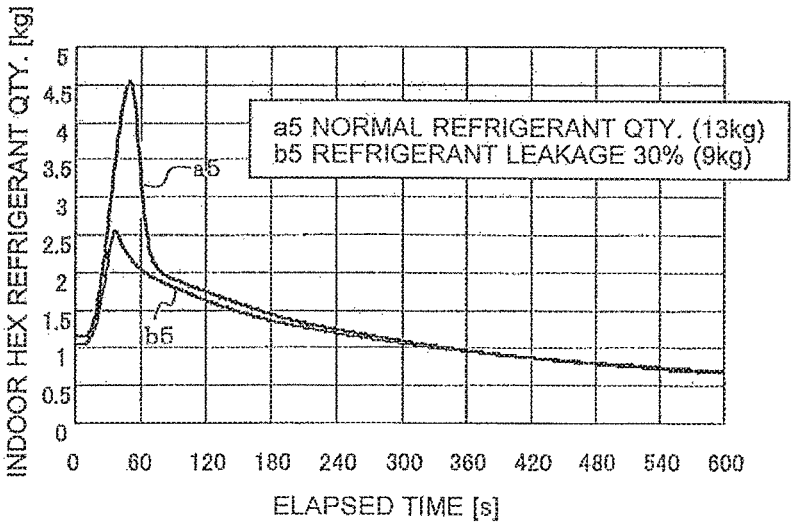
FIG. 9 is a graph illustrating change in refrigerant quantity inside an indoor heat exchanger 42 with respect to elapsed time since the stopping of a compressor 21 in a refrigeration cycle apparatus according to Embodiment 1 of the present invention.

FIG. 5 is a graph illustrating changes in the refrigerant quantity inside the liquid accumulation container 24 (accumulator) with respect to the elapsed time since the stopping of the compressor 21. FIG. 6 is a graph illustrating changes in the refrigerant quantity inside the outdoor heat exchanger 23 (outdoor HEX) with respect to the elapsed time since the stopping of the compressor 21. FIG. 7 is a graph illustrating changes in the refrigerant quantity inside the liquid-side extension pipes 6 (liquid pipes) with respect to the elapsed time since the stopping of the compressor 21. FIG. 8 is a graph illustrating changes in the refrigerant quantity inside the gas-side extension pipes 7 (gas pipes) with respect to the elapsed time since the stopping of the compressor 21. FIG. 9 is a graph illustrating changes in the refrigerant quantity inside the indoor heat exchanger 42 (indoor HEX) with respect to the elapsed time since the stopping of the compressor 21.

Before the compressor 21 stops (for example, 10 seconds before), a large quantity of refrigerant exists in the outdoor heat exchanger 23 and the liquid-side extension pipes 6, whereas only a slight quantity of refrigerant exists in the liquid accumulation container 24 and the gas-side extension pipes 7.

When the compressor 21 stops, the liquid refrigerant on the high-pressure side moves rapidly to the low-pressure side. First, the refrigerant quantity in the indoor heat exchangers 42A and 42B increases, and after a slight delay, the refrigerant quantity in the gas-side extension pipes 7 increases.

The refrigerant quantity in the indoor heat exchangers 42A and 42B and the gas-side extension pipes 7 increases temporarily, but immediately starts to decrease, and ultimately, liquid refrigerant is concentrated in the liquid accumulation container 24.

The above thus demonstrates that liquid refrigerant on the high-pressure side passes through the indoor heat exchangers 42A and 42B and the gas-side extension pipes 7, and accumulates in the liquid accumulation container 24. If the contained refrigerant quantity is insufficient during running, the liquid-side extension pipes 6 enter a two-phase state, and the difference in refrigerant quantity in the liquid-side extension pipes 6 increases compared to the case in which the normal quantity is contained. In contrast, it is demonstrated that there is little to no difference in refrigerant quantity on the low-pressure side.

The contained refrigerant quantity difference does not noticeably influence the behavior of the air conditioning apparatus 1 after stopping, and when a stable state is reached after stopping, the only factor producing a difference in the refrigerant quantity is the liquid accumulation container 24. From the above, if the liquid refrigerant quantity in the liquid accumulation container 24 can be sensed when a stable state is reached after the elapse of a certain time since the stopping of the air conditioning apparatus 1, changes in the contained refrigerant quantity, or in other words the existence of refrigerant leakage, can be sensed.

(Influence of Outdoor Temperature)

Figure 10:
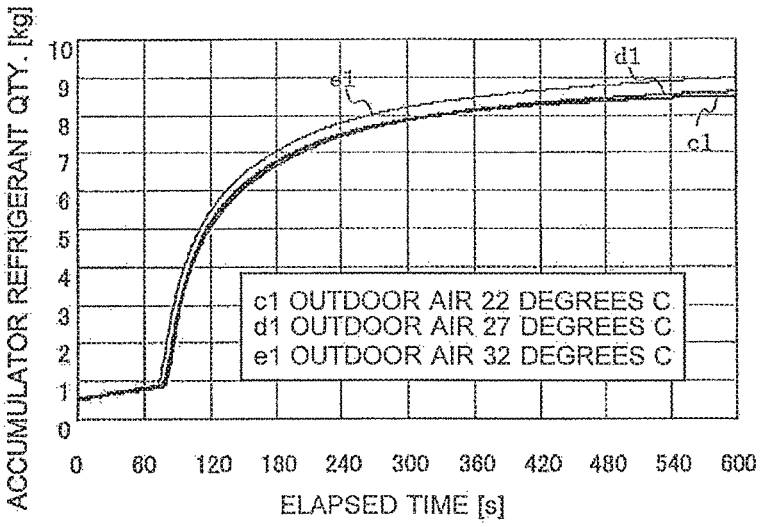
FIG. 10 is a graph illustrating, for respective outdoor temperatures, changes in refrigerant quantity inside a liquid accumulation container 24 with respect to elapsed time since the stopping of a compressor 21 in a refrigeration cycle apparatus according to Embodiment 1 of the present invention.
Figure 11:
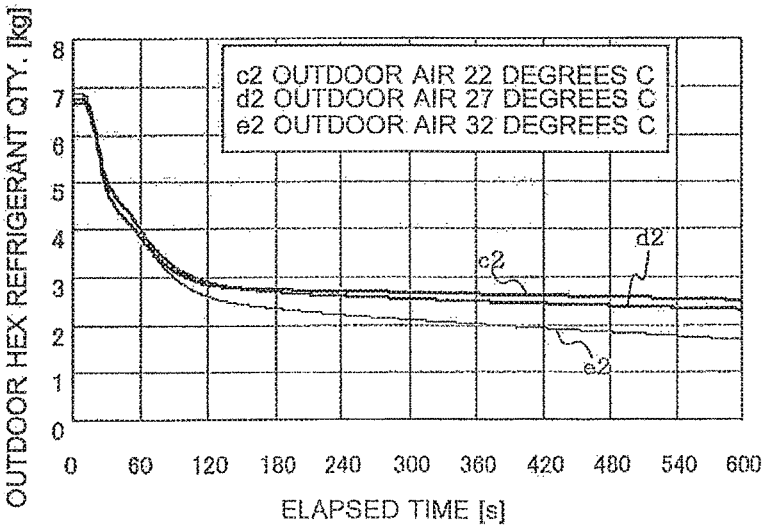
FIG. 11 is a graph illustrating, for respective outdoor temperatures, changes in refrigerant quantity inside an outdoor heat exchanger 23 with respect to elapsed time since the stopping of a compressor 21 in a refrigeration cycle apparatus according to Embodiment 1 of the present invention.

FIG. 10 is a graph illustrating, for respective outdoor temperatures, changes in the refrigerant quantity inside the liquid accumulation container 24 with respect to the elapsed time since the stopping of the compressor 21. FIG. 11 is a graph illustrating, for respective outdoor temperatures, changes in the refrigerant quantity in the outdoor heat exchanger 23 with respect to the elapsed time since the stopping of the compressor 21. FIGS. 10 and 11 illustrate the case in which the outdoor temperature is 22 degrees C. (lines c1 and c2), the case of 27 degrees C. (lines d1 and d2), and the case of 32 degrees C. (lines e1 and e2).

If the outdoor temperature is higher than the indoor temperature, the refrigerant quantity that remains in the outdoor heat exchanger 23 decreases, and the quantity that remains in the liquid accumulation container 24 increases slightly (approximately 3%).

From this, it is possible to sense changes in the contained refrigerant quantity even more accurately by accounting for the temperature difference between the outdoor temperature and the indoor temperature.

(Influence of Height Difference)

Figure 12:
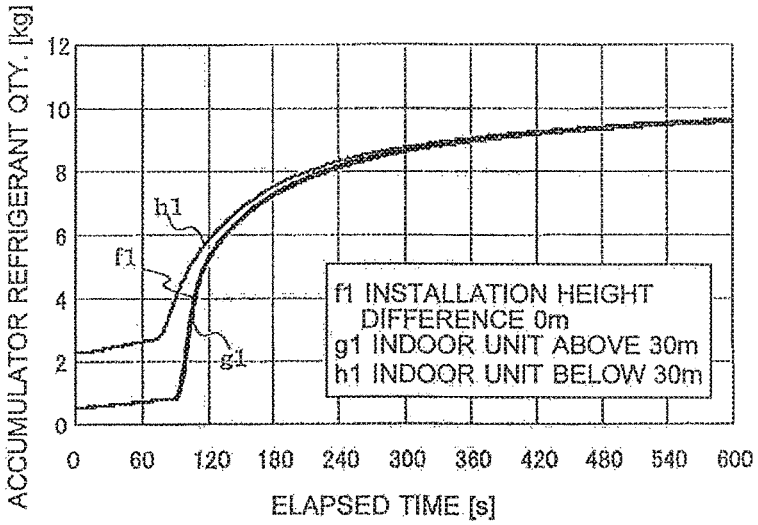
FIG. 12 is a graph illustrating, for respective height differences between an indoor unit 4 and an outdoor unit 2, changes in refrigerant quantity inside a liquid accumulation container 24 with respect to elapsed time since the stopping of a compressor 21 in a refrigeration cycle apparatus according to Embodiment 1 of the present invention.
Figure 13:
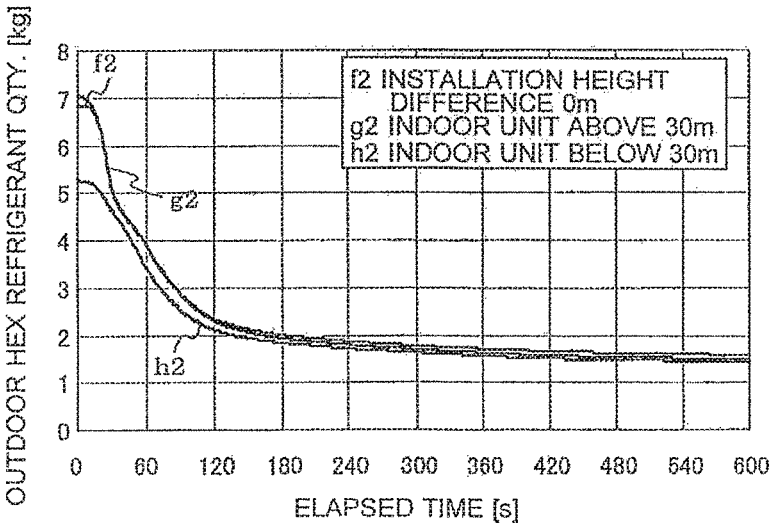
FIG. 13 is a graph illustrating, for respective height differences between an indoor unit 4 and an outdoor unit 2, changes in refrigerant quantity inside an outdoor heat exchanger 23 with respect to elapsed time since the stopping of a compressor 21 in a refrigeration cycle apparatus according to Embodiment 1 of the present invention.

The installation position (height) of the indoor unit 4 was varied over a range of ±30 m with respect to the outdoor unit 2, and the influence on the pressure head of the liquid-side extension pipes 6 was investigated. FIG. 12 is a graph illustrating, for respective height differences between the indoor unit 4 and the outdoor unit 2, changes in refrigerant quantity inside the liquid accumulation container 24 with respect to elapsed time since the stopping of the compressor 21. FIG. 13 is a graph illustrating, for respective height differences between the indoor unit 4 and the outdoor unit 2, changes in refrigerant quantity in the outdoor heat exchanger 23 with respect to elapsed time since the stopping of the compressor 21. FIGS. 12 and 13 illustrate the case in which the height difference between the indoor unit 4 and the outdoor unit 2 is 0 m (lines f1 and f2), the case in which the indoor unit 4 is installed 30 m above the outdoor unit 2 (lines g1 and g2), and the case in which the indoor unit 4 is installed 30 m below the outdoor unit 2 (lines h1 and h2).

Even if the liquid pipe head is changed, no changes are seen in the stabilized refrigerant quantity after the stopping of the air conditioning apparatus 1. The above thus demonstrates that the refrigerant quantity inside the liquid accumulation container 24 in the stable state after the stopping of the air conditioning apparatus 1 does not depend on the installation conditions.

A method of detecting the liquid level by measuring the surface temperature of the liquid accumulation container 24 after the stopping of the air conditioning apparatus 1 will be described.

In a case in which azeotropic refrigerant or near-azeotropic refrigerant is contained in the air conditioning apparatus 1 as refrigerant, the temperature of liquid and gas inside the liquid accumulation container 24 is equal, but if just a temperature sensor is provided in the liquid accumulation container 24, liquid and gas cannot be distinguished from each other. However, after the air conditioning apparatus 1 stops, whereas the pressure in the liquid accumulation container 24 changes suddenly and the temperature of the gas-phase part follows the pressure variation, the liquid-phase part has thermal capacity, and the temperature of the liquid-phase part is delayed with respect to the pressure variation. Thus, a temperature difference is produced between the gas-phase part and the liquid-phase part. However, since even the liquid-phase part has a limit to the thermal capacity, if 30 minutes or more elapse after the air conditioning apparatus 1 stops, the temperatures of the gas-phase part and the liquid-phase part become equal, and the temperature difference disappears.

Also, even in the case of filling the refrigerant circuit 10 with non-azeotropic refrigerant, when the saturated gas temperature and the saturated liquid temperature are close, the temperature difference between gas and liquid is small, which creates the possibility of incorrect detection. Since a temperature difference can be produced between the gas-phase part and the liquid-phase part after the stopping of the air conditioning apparatus 1, gas and liquid can be distinguished from each other effectively at the installation position of the temperature sensor, even if non-azeotropic refrigerant is used.

Gas and liquid may also be distinguished from each other by installing multiple temperature sensors capable of distinguishing between gas and liquid (for example, three temperature sensors (liquid level sensors 36*a* to 36*c*) as illustrated in FIG. 1) in the vertical direction of the liquid accumulation container 24. With this arrangement, in the air conditioning apparatus 1, the liquid level position inside the liquid accumulation container 24 can be specified, which can be converted to the liquid refrigerant quantity inside the liquid accumulation container 24. In other words, the multiple temperature sensors function as a sensor unit of a liquid level detecting apparatus installed in the liquid accumulation container 24. Note that the liquid refrigerant quantity conversion process will be described in detail later.

In FIG. 1, the simplest configuration of attaching temperature sensors only is illustrated as the configuration of the sensor unit of the liquid level detecting apparatus installed in the liquid accumulation container 24, but the configuration is not limited thereto. For example, heat insulation may be installed on the outside of the temperature sensors to eliminate outside influence as much as possible, or a heat-conducting sheet may be installed between the liquid accumulation container 24 and the temperature sensors to reliably impart the surface temperature of the liquid accumulation container 24 to the temperature sensors. As the material of the heat insulation used at this point, foam insulation as typified by polystyrene foam, phenol foam, and urethane foam may be used, or fiber insulation as typified by glass wool may be used. Also, for the heat-conducting sheet, silicone with good heat conduction or a metal sheet with good heat conduction such as copper or aluminum (soaking sheet) may be used, but the configuration is not limited to a soaking sheet, and a substance such as heat-conducting grease may also be used to prevent the formation of an air layer.

<Gas-Liquid Distinguishing Principle>

Next, the principle of distinguishing between gas and liquid refrigerant will be described, taking the case of stopping the compressor 21 as an example. First, the determination of the liquid level position inside the liquid accumulation container 24 will be described on the basis of FIG. 14, and after that, a gas-liquid distinguishing method will be described on the basis of FIGS. 15 and 16.

Figure 14:
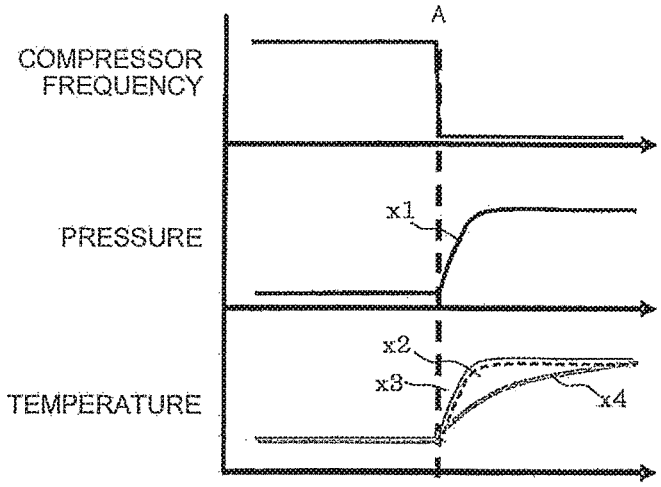
FIG. 14 is a graph illustrating change over time in the frequency of a compressor 21 and the low-pressure side pressure, saturation temperature, gas-phase temperature, and liquid-phase temperature inside a liquid accumulation container 24 in a refrigeration cycle apparatus according to Embodiment 1 of the present invention.

Changes in the pressure and temperature inside the liquid accumulation container 24 in the case of stopping the compressor 21 will be described using the test data in FIG. 14. FIG. 14 is a graph illustrating change over time in the frequency of the compressor 21 and the low-pressure side pressure, saturation temperature, gas-phase temperature, and liquid-phase temperature inside the liquid accumulation container 24 when the compressor 21 is stopped at a certain time A. The horizontal axis in FIG. 14 represents time.

As illustrated in FIG. 1, the liquid accumulation container 24 is installed on the suction side of the compressor 21. Since the liquid accumulation container 24 is connected to the low-pressure side, the pressure inside the liquid accumulation container 24 exhibits a low value until the compressor 21 is stopped. Also, the inside of the liquid accumulation container 24 is in a state in which liquid phase exists in the bottom part and gas phase exists in the top part, or in other words, a two-phase state.

Regarding the refrigerant of the air conditioning apparatus 1, in the case of using an azeotropic refrigerant for which the saturated gas temperature and the saturated liquid temperature are equal, or a near-azeotropic refrigerant for which the saturated gas temperature and the saturated liquid temperature are nearly equal, for example, in the two-phase state in which there is no temperature difference between the gas-phase part and the liquid-phase part, distinguishing gas and liquid from each other is demonstrably difficult.

Also, even in the case of filling the refrigerant circuit 10 with non-azeotropic refrigerant, when the saturated gas temperature and the saturated liquid temperature are close, the temperature difference between gas and liquid is small, which demonstrably creates the possibility of incorrect detection.

If the compressor 21 is stopped at a certain time A, the pressure difference between high and low pressure in the refrigeration cycle disappears, and the pressure equalizes. With this arrangement, the internal pressure inside the liquid accumulation container 24 rises as indicated by the line x1 in FIG. 14, and the saturation temperature of the refrigerant also rises as indicated by the line x2. At this point, if the inside of the liquid accumulation container 24 is gas phase, the temperature follows the line x3 that varies equally with the saturation temperature line x2, whereas if the inside of the liquid accumulation container 24 is liquid phase, the temperature gradually approaches the saturation temperature (line x2) as indicated by the line x4.

The above thus demonstrates that a difference is produced in the surface temperature of the liquid accumulation container 24 after the compressor 21 is stopped, depending on the internal state of the liquid accumulation container 24, or in other words, depending on whether the internal state is gas phase or liquid phase. For this reason, by measuring the surface temperature of the liquid accumulation container 24, the liquid level position inside the liquid accumulation container 24 can be determined.

(Gas-Liquid Distinguishing Method)

Figure 15:
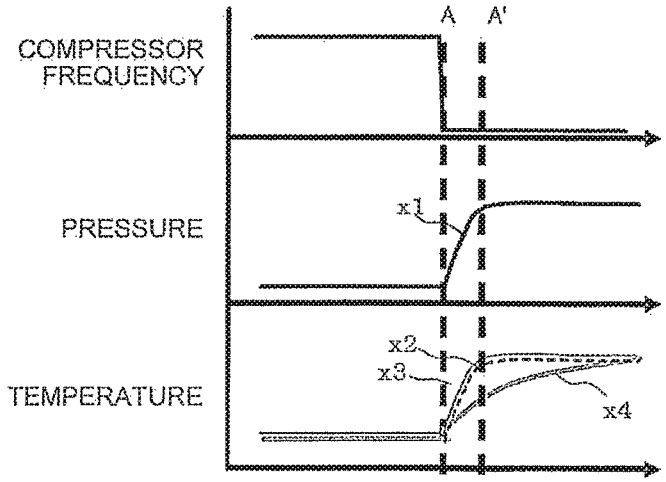
FIG. 15 is a graph illustrating change over time in the frequency of a compressor 21 and the low-pressure side pressure, saturation temperature, gas-phase temperature, and liquid-phase temperature inside a liquid accumulation container 24 in a refrigeration cycle apparatus according to Embodiment 1 of the present invention.
Figure 16:
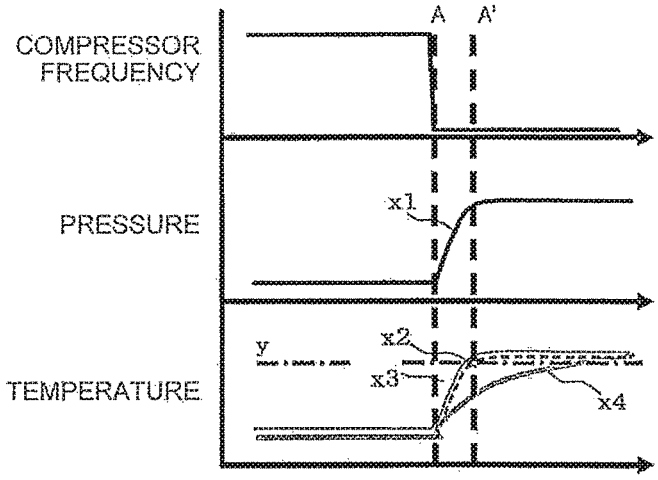
FIG. 16 is a graph adding outdoor temperature to the graph illustrated in FIG. 15.

Next, a gas-liquid distinguishing method will be described with reference to FIG. 15, taking the case of stopping the compressor 21 as an example. FIG. 15 is a graph illustrating change over time in the frequency of the compressor 21 and the low-pressure side pressure, saturation temperature, gas-phase temperature, and liquid-phase temperature inside the liquid accumulation container 24 when the compressor 21 is stopped at a certain time A. FIG. 16 is a graph adding outdoor temperature to the graph illustrated in FIG. 15. The horizontal axis in FIGS. 15 and 16 represents time.

One gas-liquid distinguishing method is a method of distinguishing between gas and liquid by temperature data when a certain time elapses from a change in the state of a component device. This method is a method of distinguishing between gas and liquid by measuring the temperature of the liquid accumulation container 24 after a certain length of time (for example, 5 minutes) elapses from the stopping of a component device, namely the compressor 21, and treating the saturation temperature of the low-pressure side pressure as a threshold value.

Basically, the gas-phase part has the same temperature as the saturated gas temperature, but to account for factors such as the heat conduction of the container and the sensor error, the gas-liquid determination is given a width $\alpha$, and gas and liquid are distinguished from each other by the following formulas.

$$|\text{Threshold value}-\text{measured value}|<\alpha \rightarrow \text{Gas-phase part}$$

$$|\text{Threshold value}-\text{measured value}|>\alpha \rightarrow \text{Liquid-phase part}$$

At this point, the reason for setting the certain length of time to 5 minutes, for example, is because when testing was performed, approximately 5 minutes passed until the pressure stabilized (that is, until the time A' illustrated in FIG. 15 was reached) after varying the component devices. Thus, by setting the certain length of time to approximately 5 minutes, it becomes easier to distinguish the difference between the gas and liquid temperatures. Obviously, this time varies depending on the device configuration and operation state of the air conditioning apparatus 1. Given the above, it is necessary to take such factors into account to set a time enabling easier distinguishing between gas and liquid for respective conditions. Note that it is sufficient to treat the certain length of time as being from 1 minute to 30 minutes, and set the certain length of time from within this range, in accordance with the conditions.

The above thus illustrates as an example a case of distinguishing between gas and liquid from the temperature difference with the saturated gas temperature, but the configuration is not limited thereto. In a case in which specifying the liquid level position is possible by using the characteristic of the temperature of the gas-phase part becoming equal to the saturation temperature, or in other words, in the case in which the temperature is equal at multiple measurement points, the relevant measurement location can be determined to be the gas-phase part. Meanwhile, if the temperature is different at multiple measurement points, the relevant measurement location can be determined to be the liquid-phase part. With this arrangement, gas and liquid can be distinguished from each other by using the characteristic of the temperature becoming equal to the saturation temperature in the gas-phase part. However, in this case, since the liquid accumulation container 24 is made of metal with good heat conduction, it is necessary to distinguish between gas and liquid while also accounting for the heat conduction at the container portion of the liquid accumulation container 24.

In addition, although a method of distinguishing between gas and liquid from temperature data after a certain length of time elapses is described, the configuration is not limited thereto, and gas and liquid may also be distinguished from each other by treating a temperature as a threshold value, for example. For example, in the case in which the air conditioning apparatus 1 is stopped as illustrated in FIG. 16, the saturation temperature in the liquid accumulation container 24 is considered to asymptotically approach the outdoor temperature. Also, the temperature difference between the gas and liquid parts tends to become greater in the portion where the saturation temperature reaches the outdoor temperature. From the above, by treating the saturation temperature as a trigger and distinguishing between gas and liquid at the time A' at which the saturation temperature reaches the outdoor temperature (line y), it becomes possible to distinguish between gas and liquid in the state of a large temperature difference between the gas and liquid parts. In this way, even if a certain length of time is not set, it is still possible to distinguish between gas and liquid in the portion where the temperature difference between gas and liquid is large.

Otherwise, measurement values may also be integrated for a certain length of time since a change in a component device, and gas and liquid may be distinguished from differences in the integrated value.

(Liquid Level Determination Method)

As described above, by varying the internal pressure or temperature in the liquid accumulation container 24, it is possible to distinguish whether the installation height of a temperature sensor is in the gas phase or in the liquid phase from a measurement of the surface temperature of the liquid accumulation container 24. Thus, according to the air conditioning apparatus 1, by installing multiple temperature sensors (liquid level sensors 36*a* to 36*c*) at positions of different height on the side of the liquid accumulation container 24, it becomes possible to sense the liquid level position of the liquid accumulation container 24.

(Periods During Which the Air Conditioning Apparatus 1 is Stopped for Long Period of Time)

In (mid-)spring or (mid-)autumn, the air conditioning apparatus 1 is stopped for long periods of time in some cases. As described above, if 30 minutes or more elapse from the stopping of the air conditioning apparatus 1, the temperatures of the gas-phase part and the liquid-phase part inside the liquid accumulation container 24 become equal. For this reason, during periods in which the air conditioning apparatus 1 is stopped for a long period of time, detecting the liquid level position of the liquid accumulation container 24 becomes difficult.

Also, if a long time elapses after the air conditioning apparatus 1 stops, the refrigerant quantity inside the liquid accumulation container 24 decreases, and the refrigerant quantity inside the indoor heat exchangers 42A and 42B or inside the outdoor heat exchanger 23 increases in some cases. For example, after cooling operation stops, refrigerant inside the liquid accumulation container 24 evaporates due to a high ambient temperature around the liquid accumulation container 24, and condenses inside the indoor heat exchangers 42A and 42B where the ambient temperature is low. Consequently, if a long time elapses after cooling operation stops, some of the refrigerant inside the liquid accumulation container 24 moves into the indoor heat exchangers 42A and 42B. As another example, after heating operation stops, refrigerant that has evaporated inside the liquid accumulation container 24 condenses inside the outdoor heat exchanger 23 due to the influence of outdoor wind. Consequently, if a long time elapses after heating operation stops, some of the refrigerant inside the liquid accumulation container 24 moves to the outdoor heat exchanger 23. In this way, if a long time elapses after the air conditioning apparatus 1 stops, the refrigerant quantity inside the liquid accumulation container 24 decreases in some cases, thereby making it difficult to determine the existence of refrigerant leakage on the basis of the quantity of liquid refrigerant inside the liquid accumulation container 24.

Consequently, in Embodiment 1, during periods in which the air conditioning apparatus 1 is stopped for a long period of time, the air conditioning apparatus 1 is made to run for a certain time before performing refrigerant leakage detection, and then refrigerant leakage detection is conducted after stopping the air conditioning apparatus 1.

(Flow of Refrigerant Leakage Detection)

Next, the flow of a refrigerant leakage detecting method in the air conditioning apparatus 1 will be described. Note that the process of refrigerant leakage detection is executed continuously while the air conditioning apparatus 1 is running and while stopped, or only while the air conditioning apparatus 1 is stopped. Also, the air conditioning apparatus 1 is configured to transmit refrigerant leakage existence data indicating a refrigerant leakage detection result to a destination such as a management center (not illustrated) via a communication line, thereby enabling remote monitoring.

Figure 17:
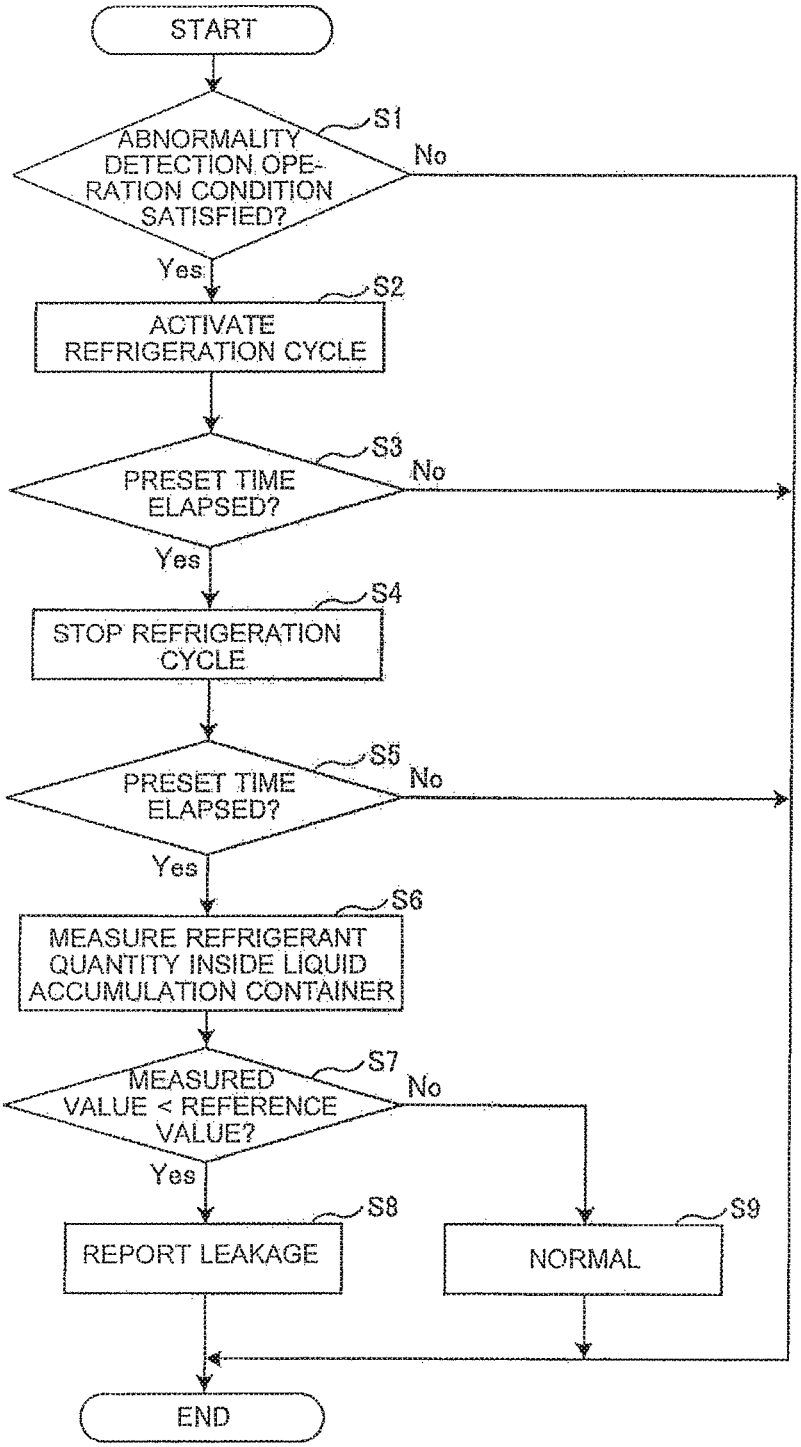
FIG. 17 is a flowchart illustrating a flow of a refrigerant leakage detecting process executed by a control unit 3 of a refrigeration cycle apparatus according to Embodiment 1 of the present invention.

FIG. 17 is a flowchart illustrating the flow of a refrigerant leakage detecting process (an example of an abnormality detecting process) executed by the control unit 3 while the air conditioning apparatus 1 is stopped. The refrigerant leakage detecting process illustrated in FIG. 17 is executed repeatedly on a certain time interval continuously, including while the air conditioning apparatus 1 is running and while stopped, or only while the air conditioning apparatus 1 is stopped, for example. First, the control unit 3 determines whether or not an abnormality detection operation condition is satisfied (step S1). The abnormality detection operation condition may be that a preset set time (for example, one week) has elapsed since the compressor 21 was stopped previously, or that the outdoor temperature is within a preset temperature range, for example. The abnormality detection operation condition in this example at least includes that a set time has elapsed since the compressor 21 was stopped previously. The condition that the outdoor temperature is within a preset temperature range is for raising the accuracy of abnormality detection by comparing data when the environmental conditions are nearly equal. In the case of determining that the abnormality detection operation condition has been satisfied, the process proceeds to step S2, whereas in the case of determining that the abnormality detection operation condition has not been satisfied (including the case in which the air conditioning apparatus 1 is running), the process ends.

In step S2, the control unit 3 causes the refrigeration cycle to operate (compressor 21). At the same time as the activation of the refrigeration cycle, the elapsed time since activation is measured.

Next, the control unit 3 determines whether or not the elapsed time since the refrigeration cycle was caused to operate has reached a certain preset time (for example, approximately 3 minutes) (step S3). In the case of determining that the elapsed time since the refrigeration cycle was caused to operate has reached the certain time, the process proceeds to step S4, whereas in the case of determining that the elapsed time has not reached the certain time, the process ends.

In step S4, the control unit 3 stops the refrigeration cycle (compressor 21). At the same time as the stopping of the refrigeration cycle, the elapsed time since stopping is measured. By temporarily running and then stopping the refrigeration cycle, a state is reached whereby the refrigerant quantity can be ascertained, even if the refrigeration cycle has been stopped for a long period of time.

Next, the control unit 3 determines whether or not the elapsed time since the refrigeration cycle stopped running has reached a certain preset time (for example, approximately 10 minutes) (step S5). In the case of determining that the elapsed time since the refrigeration cycle was stopped has reached the certain time, the process proceeds to step S6, whereas in the case of determining that the elapsed time has not reached the certain time, the process ends.

In step S6, the control unit 3 measures the quantity of liquid refrigerant inside the liquid accumulation container 24, on the basis of detecting signals from the liquid level sensors 36*a* to 36*c*. A process of computing the quantity of liquid refrigerant inside the liquid accumulation container 24 will be described later using FIG. 18.

Next, the control unit 3 compares the measured value (or the computed value) of the quantity of liquid refrigerant inside the liquid accumulation container 24 to a preset reference value (for example, an initial refrigerant quantity computed in advance by a method such as initial learning), and determines whether or not the measured value is a value less than the reference value (step S7). In the case of determining that the measured value is a value less than the reference value (measured value<reference value), the process proceeds to step S8, whereas in the case of determining that the measured value is a value equal to or greater than the reference value (measured value≥reference value), the process proceeds to step S9.

In step S8, the control unit 3 determines that refrigerant inside the refrigeration cycle is leaking, and uses devices such as the output unit 3*h* and the display unit 3*i* to report that a refrigerant leak is occurring to persons such as a user and an administrator.

In step S9, the control unit 3 determines that refrigerant inside the refrigeration cycle is not leaking, and uses devices such as the output unit 3*h* and the display unit 3*i* to report that the refrigerant quantity is normal to persons such as a user and an administrator.

At this point, the input unit 3*g* (for example, an operation switch) may also have a function of switching the operation mode of the air conditioning apparatus 1 between a normal operation mode that includes a cooling operation mode and a heating operation mode, and an abnormality detecting mode that detects an abnormality in the refrigeration cycle (for example, refrigerant leakage) at times such as in periods during which the air conditioning apparatus 1 is stopped for a long period of time. In this case, the control unit 3 may be configured to execute the refrigerant leakage detecting process illustrated in FIG. 17 only when the operation mode of the air conditioning apparatus 1 is set to the abnormality detecting mode.

Also, in the refrigerant leakage detecting process, in the case of determining that the measured value of the quantity of liquid refrigerant is a value greater than the reference value, devices such as the output unit 3*h* and the display unit 3*i* may also be used to report that the refrigerant quantity inside the refrigeration cycle is excessive to persons such as a user and an administrator.

(Flow of Liquid Refrigerant Quantity Computation)

Figure 18:
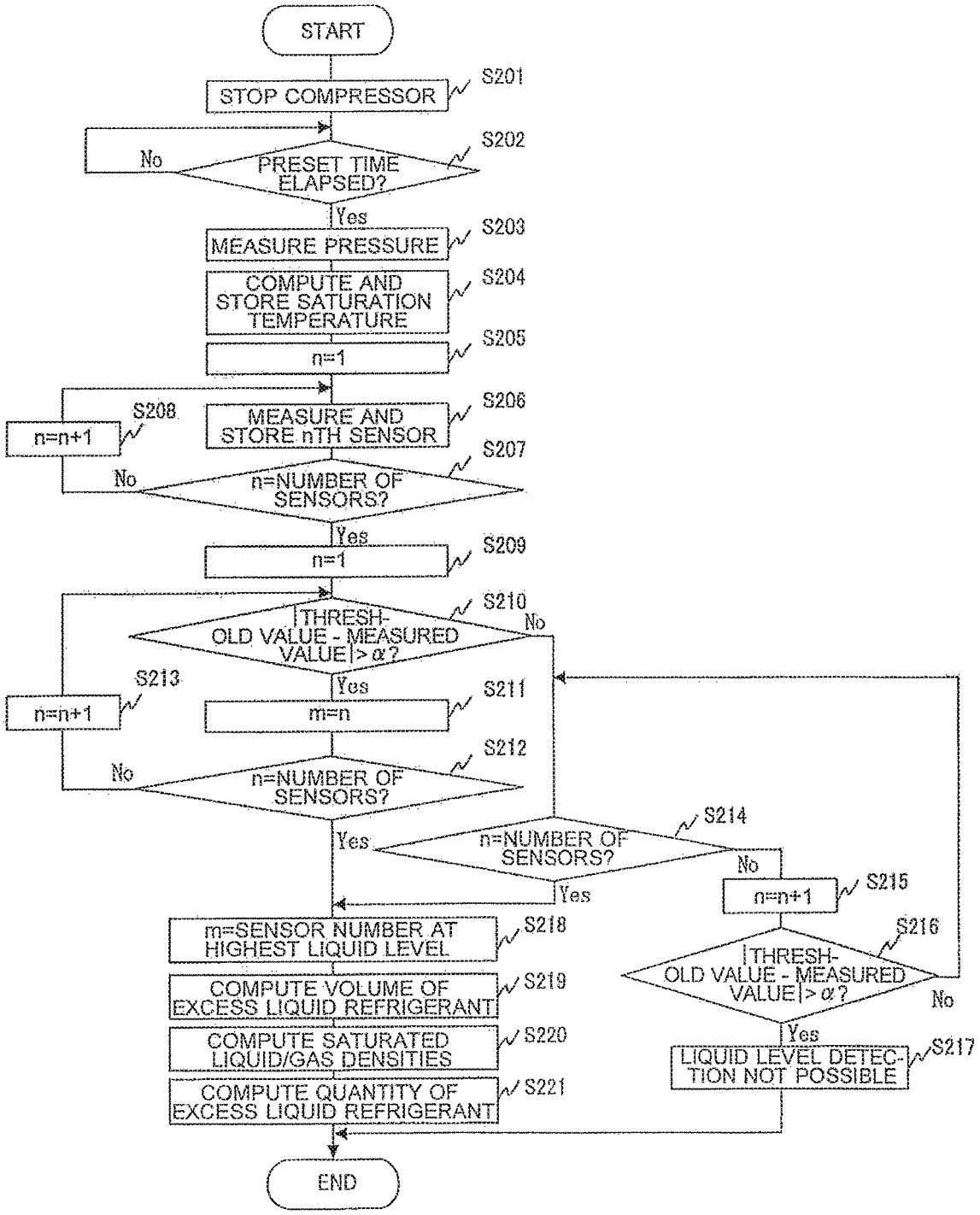
FIG. 18 is a flowchart illustrating a flow of a liquid refrigerant quantity computing process in step S6 of FIG. 17.

Next, the flow of the computation of the quantity of liquid refrigerant inside the liquid accumulation container 24 in step S6 of FIG. 17 will be described with reference to FIG. 18. FIG. 18 is a flowchart illustrating the flow of a liquid refrigerant quantity computing process in step S6 of FIG. 17.

First, in step S201, the control unit 3 confirms that the compressor 21 is stopped.

Next, in step S202, the control unit 3 determines whether or not a certain time (for example, approximately 10 minutes) has elapsed. If the certain time has elapsed, the process proceeds to step S203, and the pressure is measured. In Embodiment 1, since the liquid accumulation container 24 is installed on the low-pressure side of the refrigeration cycle, the low-pressure side pressure is measured using the suction pressure sensor 34*a*.

In step S204, the control unit 3 calculates the saturation temperature from the pressure measured in step S203, and stores the calculated saturation temperature in the storage unit 3*e* as a threshold value. After that, the control unit 3 measures the surface temperature of the liquid accumulation container 24 on the basis of information from the liquid level sensors 36*a* to 36*c* installed on the surface of the liquid accumulation container 24 (step S205 to step S208).

First, in step S205, the control unit 3 sets n=1.

Subsequently, in step S206, on the basis of information from the nth liquid level sensor (for example, the liquid level sensor 36*a*), the control unit 3 measures and stores the surface temperature of the liquid accumulation container 24 at the installation position of that liquid level sensor.

In step S207, the control unit 3 determines whether or not n is equal to the number of sensors.

If n is not equal to the number of sensors, in step S208, the control unit 3 increments n by 1, and executes the process in step S206 again.

After measuring and storing the surface temperature of the liquid accumulation container 24 on the basis of information from all of the liquid level sensors 36*a* to 36*c* (step S207; Yes), the control unit 3 again sets n=1 in step S209.

Steps S210 to S218 illustrate the flow of specifying the liquid level position.

In step S210, the control unit 3 computes the temperature difference between the threshold value, namely the saturation temperature, and the measured value, and determines whether or not the absolute value of the temperature difference is less than or equal to $\alpha$. In other words, in step S210, the control unit 3 distinguishes between gas and liquid.

If the absolute value of the temperature difference is greater than $\alpha$ ($|\text{threshold value}-\text{measured value}|>\alpha$), the liquid-phase part having a large temperature difference from the saturation temperature can be determined, and the control unit 3 proceeds to step S211. In step S211, the sensor number that passed through step S210 is taken to be m, and the process proceeds to the next liquid level sensor. If there is a liquid level sensor in the liquid-phase part of the liquid accumulation container 24, the control unit 3 repeats steps S210 to S213, and stores as m the sensor number of the sensor at the highest position in the liquid-phase part (step S218).

If the absolute value of the temperature difference is less than or equal to $\alpha$ ($|\text{threshold value}-\text{measured value}|\leq\alpha$), it is determined that the gas-phase part that is nearly equal to the saturation temperature is detected, and the control unit 3 proceeds to step S214. Once the gas-phase part is determined in step S210, as long as a sensor fault does not occur, it is inconceivable that it is determined that a liquid-phase part is detected later from the principles of the gas-liquid distinguishing process in Embodiment 1. Thus, the control unit 3 increments n by 1 in step S215, and proceeds to the determination in step S216. If it is determined that the liquid-phase part is detected in step S216 (if the absolute value of the temperature difference is greater than $\alpha$), the control unit 3 proceeds to step S217, and uses devices such as the output unit 3*h* and the display unit 3*i* to report that liquid level detection is not possible and the quantity of liquid refrigerant cannot be computed.

On the other hand, if it is determined that the gas-phase part is detected in step S216 (if the absolute value of the temperature difference is less than or equal to $\alpha$), the control unit 3 repeats steps S214 to S216 for all of the liquid level sensors 36*a* to 36*c*.

With the above flow from step S210 to step S218, the control unit 3 is able to specify the sensor number m of the sensor at the highest position in the liquid-phase part.

Next, in step S219, the control unit 3 computes the volume of liquid refrigerant inside the liquid accumulation container 24 from the sensor number of the sensor determined to be at the highest position in the liquid-phase part. The volume of liquid refrigerant is computed from a relationship between the sensor number and the volume of liquid refrigerant stored in advance in the storage unit 3*e*.

Next, in step S220, the control unit 3 computes the saturated gas density and the saturated liquid density from the pressure inside the liquid accumulation container 24.

Next, in step S221, the control unit 3 computes the quantity of liquid refrigerant inside the liquid accumulation container 24 from the volume of liquid refrigerant as well as the saturated gas density and saturated liquid density in the liquid accumulation container 24 computed in step S219 and step S220.

The above is described under the presupposition that there is a known relationship between the positions of the liquid level sensors 36*a* to 36*c* installed on the surface of the liquid accumulation container 24 and the liquid quantity, but the configuration is not limited thereto. For example, in cases such as when an existing air conditioning apparatus is retrofitted with temperature sensors, the relationship between the positions of the temperature sensors and the liquid quantity is unknown. In such cases, after the temperature sensors are installed, it becomes possible to sense the quantity of liquid refrigerant by adding an initial learning step in which the relationship between the number of the temperature sensor at the highest position in the liquid-phase part and the liquid volume is sensed under multiple conditions with varying quantities of liquid refrigerant, and the sensed relationship is stored as a database.

As described above, the air conditioning apparatus 1 is configured to specify the liquid level position by measuring the temperature under conditions in which the gas-phase part and the liquid-phase part exist at different temperatures at the surface of the liquid accumulation container 24. With this arrangement, according to the air conditioning apparatus 1, liquid level sensors can be realized with a simple configuration using only temperature sensors, and the effective advantages of low cost, reduced variations in measured values, and easy sensor installation are exhibited.

<Method of Improving Detection Accuracy>

Next, a method for improving the accuracy of detecting refrigerant leakage will be described.

To improve the accuracy of detecting refrigerant leakage, it is desirable to keep the quantity of the refrigerant accumulated in the liquid accumulation container 24 at a fixed quantity at a certain timing of measuring the quantity of accumulated liquid, regardless of the environmental state. Realizing the above requires measures such as equalizing the refrigeration cycle state before stopping, equalizing the states of the respective component devices while being stopped, setting a certain reference value for respective operation states in cases in which the operation state such as cooling/heating changes greatly, and measuring the quantity of accumulated liquid at an appropriate timing.

A specific method is described below. First, a method of equalizing the refrigeration cycle state before stopping will be described. After stopping, the driving force necessary for refrigerant to move is the high/low pressure difference before the stopping of the refrigeration cycle (refrigerant circuit 10). If the high/low pressure difference before stopping is small, liquid refrigerant does not move all the way to the liquid accumulation container 24, and instead accumulates in devices along the way, such as the heat exchangers and pipes. Since the existence of refrigerant leakage is detected according to the liquid quantity in the liquid accumulation container 24, if refrigerant accumulates along the way, refrigerant leakage cannot be determined accurately. Given the above, it is necessary to set the high/low difference before the stopping of the refrigeration cycle to a certain value or greater. The required high/low difference in the refrigeration cycle is different depending on the installation environment of the outdoor unit 2 and the indoor units 4 and the pipe lengths, but if the high/low pressure difference of the refrigeration cycle is 1 MPa or greater, it is confirmed that liquid refrigerant returns to the liquid accumulation container 24 after stopping, even for a high/low difference of approximately 10 m between the outdoor unit 2 and the indoor units 4. To increase the high/low pressure difference before stopping, the compressor 21 may be made to operate at a high rotational speed (for example, at the upper limit of the rotational speed range within which the compressor 21 is able to operate) immediately before stopping.

Furthermore, to improve the accuracy of detecting refrigerant leakage, it is desirable to set the high/low pressure difference of the refrigeration cycle to a set value before stopping. By controlling the compressor 21, the outdoor fan 27, and the expansion valve 41 to equalize the operation state of the refrigeration cycle before stopping, even if environmental conditions such as the outdoor temperature change, variations in the quantity of liquid refrigerant inside the liquid accumulation container 24 are reduced. For this reason, with this arrangement, incorrect detection can be reduced, and the detection accuracy can be improved.

Next, a method of improving the accuracy of refrigerant leakage detection by equalizing the states of the respective component devices when stopping will be described. After the stopping of the compressor 21, the component devices that influence the movement of refrigerant are valves such as the expansion valve 41 and solenoid valves (opening and closing valve 28, opening and closing valve 29). If the opening degree of the valves is large, refrigerant moves easily. Conversely, if the opening degree of the valves is small, the valves impede refrigerant movement, and refrigerant moves less readily, the driving force weakens, and refrigerant accumulates in devices such as the heat exchangers and pipes. Consequently, if the opening degree states of the valves are different after stopping, the quantity accumulated in the liquid accumulation container 24 is different. Given the above, by equalizing (locking to a fixed value) the opening degree states of the valves when stopping to equalize the pressure loss, variations in the quantity of liquid refrigerant inside the liquid accumulation container 24 are reduced, and thus incorrect detection can be reduced, and the detection accuracy can be improved.

Furthermore, to improve the accuracy of detecting refrigerant leakage, the opening degree of the valves after the stopping of the compressor 21 is set to a larger opening degree than while running (preferably, the valves are fully opened). By setting the opening degree of the valves to a larger opening degree than while running, or by fully opening the valves, decreases in the driving force can be suppressed, and thus variations in the quantity of liquid refrigerant inside the liquid accumulation container 24 can be reduced, incorrect detection can be reduced, and the detection accuracy can be improved. Note that "fully open" is not limited to being "fully open" in the strict sense, and the term "fully open" is also taken to include an opening degree that is close to being fully open (an opening degree near the fully open state).

Conversely, in a case in which the opening degree of the valves is smaller than a certain value, refrigerant leakage is detected by respectively computing the refrigerant quantity of each component device other than the liquid accumulation container 24 before stopping, and the refrigerant quantity in the liquid accumulation container 24 after stopping, totaling the quantities to compute the refrigerant quantity in the system as a whole (refrigerant circuit 10 as a whole), and comparing the total to a certain reference value. This is because in the case in which the opening degree of the valves is smaller than a certain value, the driving force for driving refrigerant is small, and the refrigerant quantity distribution among the respective components after stopping depends on the refrigerant distribution during running. In this way, in the case in which the opening degree of the valves is smaller than a certain value, if the refrigerant quantity in the liquid accumulation container 24 after stopping is simply estimated as described above, incorrect detection and the detection accuracy worsen. Given the above, refrigerant leakage is detected by computing the refrigerant quantity in each component device during running from pressure and temperature data, computing the refrigerant quantity in the liquid accumulation container 24 after stopping from the liquid level sensors 36, totaling the quantities to compute the refrigerant quantity of the system as a whole, and comparing the total to a certain reference value.

In Embodiment 1, the flow of refrigerant is different between cooling operation and heating operation. In the case in which the flow is different depending on the operation state in this way, the locations where refrigerant accumulates and the quantity of the refrigerant that accumulates in devices such as the heat exchangers and pipes are different. Thus, by giving respective operation states certain reference values separately, refrigerant leakage can be determined while accounting for the quantity that accumulates in elements other than the liquid accumulation container 24. With this arrangement, incorrect detection can be reduced, and the detection accuracy can be improved.

In the case of detecting refrigerant leakage by measuring the quantity of liquid refrigerant inside the liquid accumulation container 24 after stopping, an appropriate time exists by which to raise the detection accuracy. If the timing of measuring the quantity of liquid refrigerant is early, the liquid quantity is measured before refrigerant moves from each element to the liquid accumulation container 24, and variations increase. Conversely, if the timing of measuring the quantity of liquid refrigerant is late, the quantity of the refrigerant that accumulates in devices such as the heat exchangers and pipes changes under the influence of the outdoor temperature, and variations in the refrigerant quantity in the liquid accumulation container 24 increase.

The appropriate detection timing differs depending on the lengths of pipes, the installation states of devices, such as the installation positions of the outdoor unit 2 and the indoor units 4, and the operation state, but by measuring the liquid quantity in the liquid accumulation container 24 over a range from 1 minute to 30 minutes after stopping, variations in the quantity of liquid refrigerant inside the liquid accumulation container 24 can be moderated, incorrect detection can be reduced, and the detection accuracy can be improved.

In addition, according to the air conditioning apparatus 1, it is also possible to compute a refrigerant leakage quantity by comparing the accumulated quantity of liquid refrigerant in the liquid accumulation container 24 with an initial value, and thus factors such as the degree of refrigerant leakage and the maintenance work steps can be sensed prior to maintenance, thereby improving the maintenance work efficiency.

Modifications of Embodiment 1

Embodiment 1 describes a refrigerant leakage detecting process that detects excess or insufficiency of the refrigerant on the basis of the quantity of liquid refrigerant inside the liquid accumulation container 24 after stopping the refrigeration cycle (an example of refrigeration cycle state data), but the configuration is not limited thereto. For example, after running the refrigeration cycle in step S2 of FIG. 17, excess or insufficiency of the refrigerant may also be sensed on the basis of various state data about the refrigeration cycle during running (for example, data such as the refrigerant degree of subcooling, degree of superheat, pressure, and temperature). In this case, it is also possible to omit the liquid accumulation container 24 from the refrigeration cycle.

Also, the refrigerant quantity in the refrigeration cycle as a whole may be estimated on the basis of state data about the refrigeration cycle during running, and by comparing the estimated refrigerant quantity with a reference value, excess or insufficiency of the refrigerant may be sensed. For example, the refrigerant density in each element may be computed from temperature data or pressure data about the refrigeration cycle, and by multiplying the computed refrigerant density by the internal volume of each element and totaling the results, the refrigerant quantity in the refrigeration cycle as a whole may be computed. Additionally, the temperature efficiency may be computed on the basis of the saturation temperature of the heat exchangers, the outlet refrigerant temperature, and the air temperature, and the refrigerant quantity in the refrigeration cycle as a whole may be estimated on the basis of the computed temperature efficiency.

Also, the refrigerant leakage detecting process is an example of an abnormality detecting process. In an abnormality detecting process, it is possible to sense not only excess or insufficiency of the refrigerant, but also various types of abnormalities in the refrigeration cycle on the basis of state data. Abnormalities that can be sensed on the basis of state data include abnormalities of the compressor 21, abnormalities of the expansion valves 41A and 41B, abnormalities of the outdoor fan 27, abnormalities of the indoor fans 43A and 43B, and the like.

As described above, according to Embodiment 1, an abnormality in the refrigeration cycle apparatus can be sensed, even during periods in which the refrigeration cycle apparatus is stopped over a long period of time.

Also, while the refrigeration cycle apparatus is stopped, refrigerant inside the outdoor unit 2 evaporates or condenses due to the influence of the outdoor temperature and sunshine. For this reason, in a case in which a non-azeotropic refrigerant mixture of refrigerants with different boiling points is used, if the stopped period of the refrigeration cycle apparatus becomes long, the composition of refrigerant accumulated in each element changes by evaporation or condensation, and accurately determining excess or insufficiency of the refrigerant becomes difficult. Also, factors such as drops in efficiency may also produce cases in which the refrigerant performance anticipated at the time of design cannot be exhibited. According to Embodiment 1, even in a refrigeration cycle apparatus in which non-azeotropic refrigerant is used, by running a refrigeration cycle apparatus that has been stopped over a long period of time, a state of unbalanced refrigerant composition can be reverted to an appropriate state, making it possible to sense abnormalities.

Also, in Embodiment 1, a refrigeration cycle apparatus that has been stopped for a long period is made to run for a certain time and then stopped, and an abnormality detecting process is conducted while the refrigeration cycle apparatus is stopped. Consequently, compared to a case in which a refrigeration cycle apparatus that has been stopped for a long period is made to run and a refrigerant leakage detecting process is conducted while the refrigeration cycle apparatus is running, the running time of the refrigeration cycle apparatus can be shortened in some cases. With this arrangement, energy conservation in the refrigeration cycle apparatus is possible.

Also, in the case of detecting refrigerant leakage, for example, the further advancement of refrigerant leakage can be suppressed as much as possible. With this arrangement, the reliability of the air conditioning apparatus 1 also improves, and a degraded environmental state due to the spilling of refrigerant can be prevented as much as possible.

Embodiment 2

Figure 19:
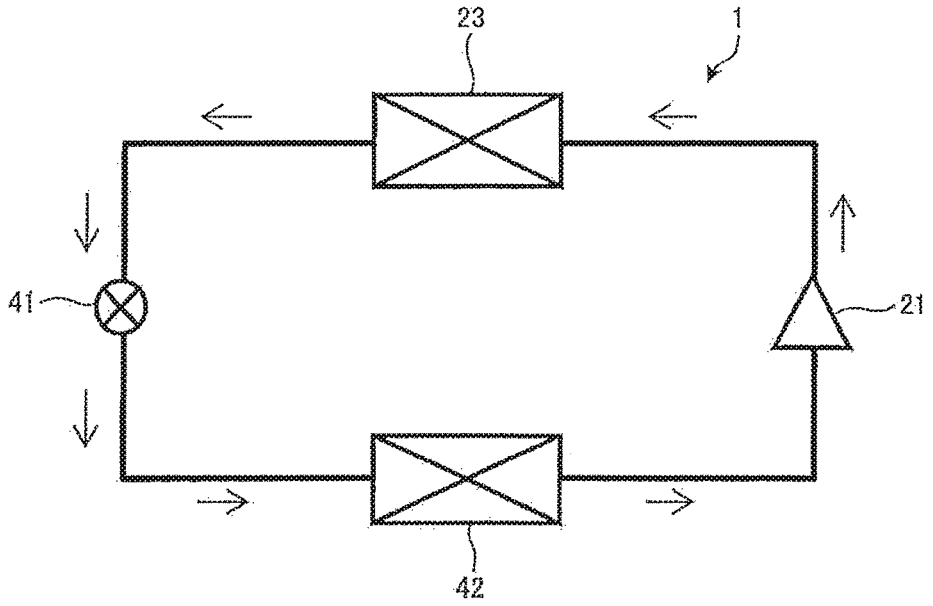
FIG. 19 is a refrigerant circuit diagram illustrating a schematic configuration of a refrigeration cycle apparatus according to Embodiment 2 of the present invention.

A refrigeration cycle apparatus according to Embodiment 2 of the present invention will be described. FIG. 19 is a refrigerant circuit diagram illustrating a schematic configuration of a refrigeration cycle apparatus according to Embodiment 2. Structural elements having the same functions and actions as Embodiment 1 will be denoted with the same signs, and description thereof will be reduced or omitted. Embodiment 2 illustrates an example of an air conditioning apparatus 1 as the refrigeration cycle apparatus. As illustrated in FIG. 19, the air conditioning apparatus 1 has a configuration in which a compressor 21, an outdoor heat exchanger 23 that functions as a condenser, for example, an expansion valve 41, and an indoor heat exchanger 42 that functions as an evaporator, for example, are connected in a loop via refrigerant pipes. Note that in FIG. 19, the control unit 3 is omitted from illustration.

Figure 20:
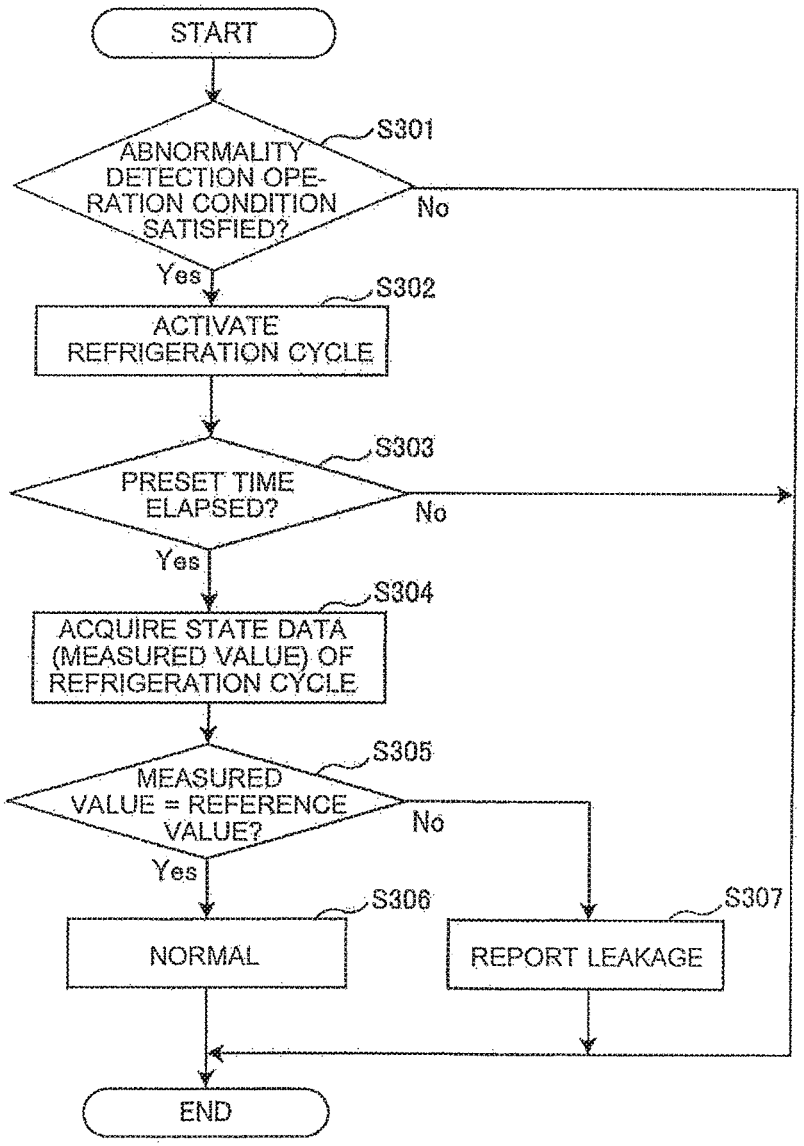
FIG. 20 is a flowchart illustrating a flow of an abnormality detecting process executed by a control unit 3 of a refrigeration cycle apparatus according to Embodiment 2 of the present invention.

FIG. 20 is a flowchart illustrating the flow of an abnormality detecting process executed by the control unit 3. The abnormality detecting process illustrated in FIG. 20 is executed repeatedly on a certain time interval continuously while the air conditioning apparatus 1 is running and while stopped, only while the air conditioning apparatus 1 is stopped, or only when the operation mode of the air conditioning apparatus 1 is set to an abnormality detecting mode, for example. Steps S301 to S303 are similar to steps S1 to S3 of FIG. 17, and thus description will be reduced or omitted.

At the time of step S304, by running the refrigeration cycle, the refrigeration cycle enters a state whereby the refrigerant quantity can be ascertained, even for a refrigeration cycle that has been stopped over a long period of time. In step S304, the control unit 3 acquires state data about the refrigeration cycle during running (for example, measured values (or computed values) of factors whose values change due to refrigerant leakage, such as the refrigerant degree of subcooling and degree of superheat).

In step S305, the control unit 3 compares the acquired measured values to preset reference values, and determines whether or not the measured values are equal to the reference values. In the case of determining that the measured values are equal to the reference values, the process proceeds to step S306, whereas in the case of determining that the measured values are not equal to the reference values (for example, in the case of determining that the degree of subcooling has dropped), the process proceeds to step S307. Note that the reference values may also be given a certain margin to account for factors such as error in the measured values and difference in environmental conditions.

In step S306, the control unit 3 determines that refrigerant inside the refrigeration cycle is not leaking, and uses devices such as the output unit 3*h* and the display unit 3*i* to report that the refrigerant quantity is normal to persons such as a user and an administrator.

In step S307, the control unit 3 determines that refrigerant inside the refrigeration cycle is leaking, and uses devices such as the output unit 3*h* and the display unit 3*i* to report that a refrigerant leak is occurring to persons such as a user and an administrator.

According to Embodiment 2, similarly to Embodiment 1, an abnormality in the refrigeration cycle apparatus can be sensed, even during periods in which the refrigeration cycle apparatus is stopped over a long period of time.

Embodiment 3

A refrigeration cycle apparatus according to Embodiment 3 of the present invention will be described. The total load torque during the startup of the compressor 21 has a relationship determined by the three factors of the initial state of the refrigerant distribution at the time of startup, the long-term deterioration of the compressor 21, and faults in the compressor 21 (such as damage to the drive shaft, for example).

Figure 21:
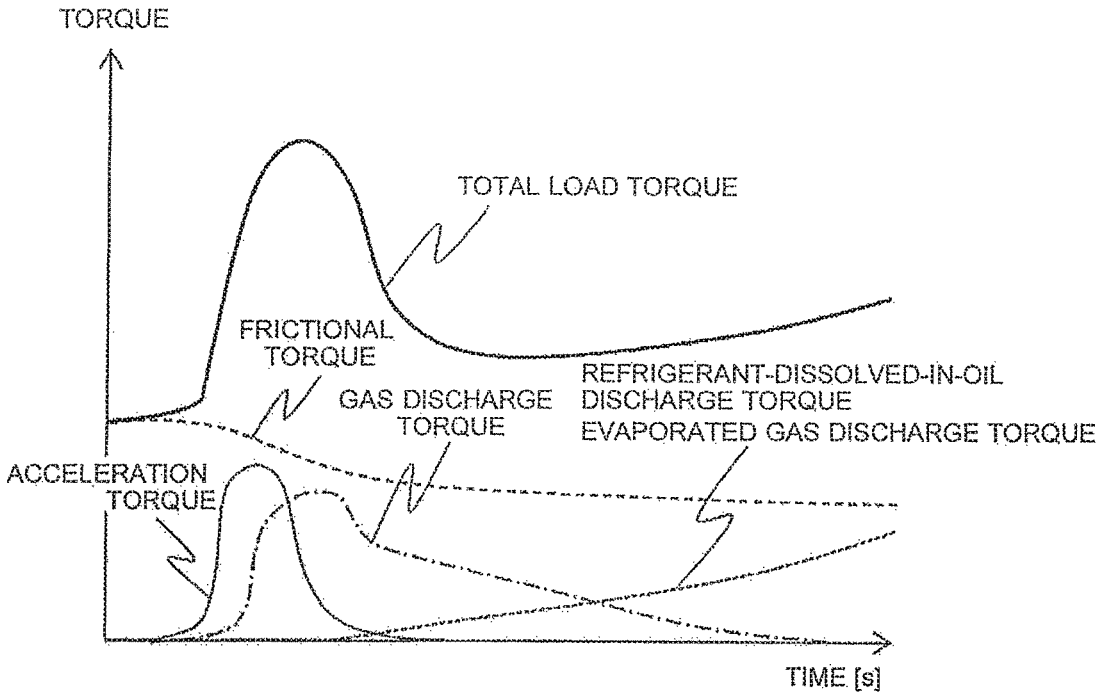
FIG. 21 is a graph illustrating change over time in a total load torque and a breakdown of the total load torque during the startup of a compressor 21 in a refrigeration cycle apparatus according to Embodiment 3 of the present invention.

FIG. 21 is a graph illustrating change over time in a total load torque and a breakdown of the total load torque during the startup of the compressor 21 in the refrigeration cycle apparatus according to Embodiment 3. The horizontal axis represents time, while the vertical axis represents torque.

The total load torque is computed by taking the sum total of the frictional torque, the acceleration torque, the gas discharge torque, the refrigerant-dissolved-in-oil discharge torque, and the evaporated gas discharge torque. The frictional torque is the torque when a movable part changes from static frictional torque to kinetic frictional torque. The acceleration torque is the torque produced when a movable part having a fixed mass accelerates. The gas discharge torque is the torque that pushes out gas refrigerant existing on the low-pressure side. The refrigerant-dissolved-in-oil discharge torque is the torque for compressing gas refrigerant, since as the suction pressure falls, refrigerant dissolved in oil gasifies. The evaporated gas discharge torque is the torque for compressing gas refrigerant produced while the evaporator cools.

Among the above three factors, the acceleration torque and the gas discharge torque change depending on the initial distribution of refrigerant before the compressor 21 is caused to operate. The initial distribution of refrigerant is determined according to chronological changes in the outdoor temperature, the indoor temperature, and the compressor shell temperature from the last stopped state until startup. In other words, by ascertaining each temperature change of the outdoor temperature, the indoor temperature, and the compressor shell temperature while the compressor 21 is stopped, the initial distribution of refrigerant inside the refrigeration cycle immediately before startup can be ascertained.

Long-term deterioration of the compressor 21 occurs due to wear on the sliding parts of the compressor 21 by normal usage, and is expressed as an increase in frictional torque.

Faults in the compressor 21 may be, for example, insufficient lubrication of the sliding parts, which causes the sliding parts to become damaged, and conceivably increases the frictional torque and the acceleration torque.

In other words, because of these three factors, namely the initial state of the refrigerant distribution at the time of startup, long-term deterioration of the compressor 21, and faults in the compressor 21, the total load torque at startup changes.

If the total load torque required to start up the compressor 21 increases, the current value required for startup increases. In other words, whether or not the total load torque at startup is increasing can be sensed by the current value. Thus, it is possible to detect the instantaneous current or the instantaneous voltage at startup imparted to the three-phase motor coil of the compressor 21, and from the detected value, estimate the internal state of the compressor 21. The instantaneous current and the instantaneous voltage at startup imparted to the three-phase motor coil can be detected by a motor driving circuit (for example, an inverter circuit).

At this point, changes in the acceleration torque and the gas discharge torque due to the initial distribution of refrigerant before the compressor 21 is caused to operate exhibit the same tendency if the distribution of refrigerant is under similar conditions. Also, since increases in frictional torque due to long-term changes in the compressor 21 are extremely small changes, by detecting the starting current (one example of state data) when the initial distribution of refrigerant before activation is under the same conditions, estimating faults in the compressor 21 (such as damage to the drive shaft, for example) becomes possible.

Figure 22:
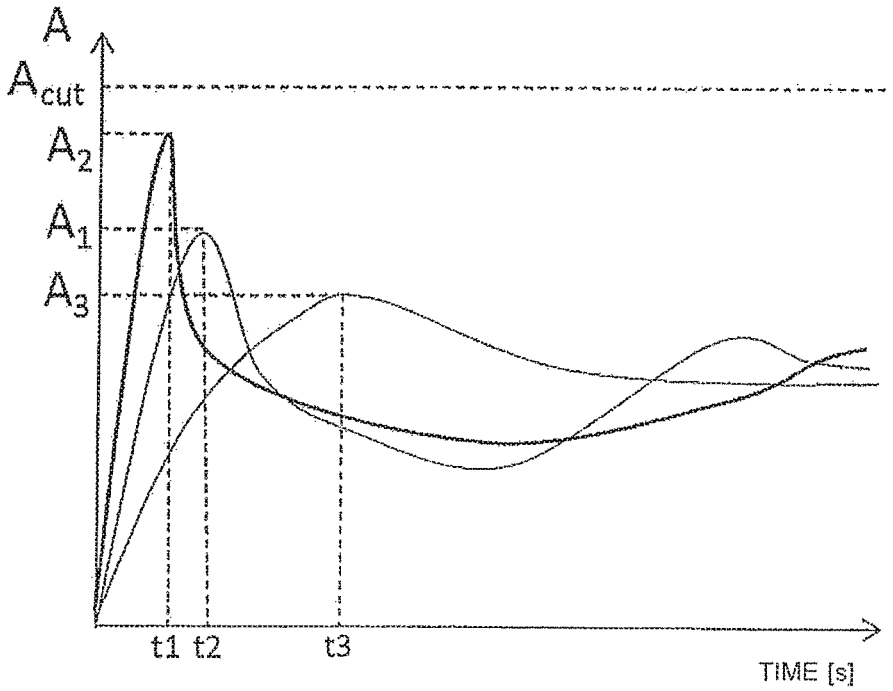
FIG. 22 is a graph illustrating a waveform of a starting current during startup of a compressor 21 in a refrigeration cycle apparatus according to Embodiment 3 of the present invention.

FIG. 22 is a graph illustrating a waveform of a starting current during startup of the compressor 21 in a refrigeration cycle apparatus according to Embodiment 3. The horizontal axis represents time, while the vertical axis represents current. In FIG. 22, A1 represents the upper-limit threshold of the current value and A3 represents the lower-limit threshold of the current value of the compressor 21 in which the initial distribution of refrigerant at the time of startup is in the normal range, while A2 represents the current value in an abnormal state in which there is insufficient lubricant in the compressor 21 due to a period of dormancy or the like, and Acut represents the current value at which an overcurrent break occurs.

The normal range of the initial distribution of refrigerant differs depending on the conditions of the usage environment, the installation of equipment, and the equipment connection conditions. However, since the revolution pattern of the compressor 21 at startup is normally fixed for each model of air conditioner, the waveform of the current value at startup is nearly the same if the initial conditions of the refrigerant distribution at the time of startup are within the normal range and the refrigerant distribution is under the same conditions.

As above, by comparing waveforms of the starting current in states of equal refrigerant distribution (for example, the waveform of a past starting current to the waveform of the current starting current), it becomes possible to sense and predict abnormalities in the compressor 21 on the basis of the waveform of the starting current.

However, if the stopped period of the refrigeration cycle apparatus (compressor 21) becomes long, refrigerant evaporates and condenses repeatedly due to the influence of the outdoor temperature and sunshine, and refrigerant moves between the outdoor unit 2, and the indoor units 4A and 4B. Consequently, the refrigerant distribution in each element of the refrigeration cycle changes. For this reason, even if the waveform of the starting current is hypothetically abnormal, it is difficult to determine whether the abnormal current is produced by an abnormality in the compressor 21 or by the movement of refrigerant. Consequently, there is a risk of incorrect detection when performing abnormality detection of the compressor 21.

Consequently, in Embodiment 3, a refrigeration cycle apparatus which has been stopped over a long period is made to run for a certain time and then stopped to bring the refrigerant distribution into a normal range. After a certain length of time elapses since stopping, the refrigeration cycle is started again, and the starting current of the compressor 21 is detected. With this arrangement, variations in the refrigerant distribution can be moderated, and thus incorrect detection when performing abnormality detection of the compressor 21 can be prevented, and the detection accuracy can be improved.

Embodiment 4

A refrigeration cycle apparatus abnormality detecting system according to Embodiment 4 of the present invention will be described. In Embodiments 1 to 3 above, abnormality detection of the refrigeration cycle apparatus is conducted by the control unit 3 of the refrigeration cycle apparatus, but in Embodiment 4, abnormality detection of the refrigeration cycle apparatus is conducted by an abnormality detecting device connected to the control unit 3 via a communication network.

Figure 23:
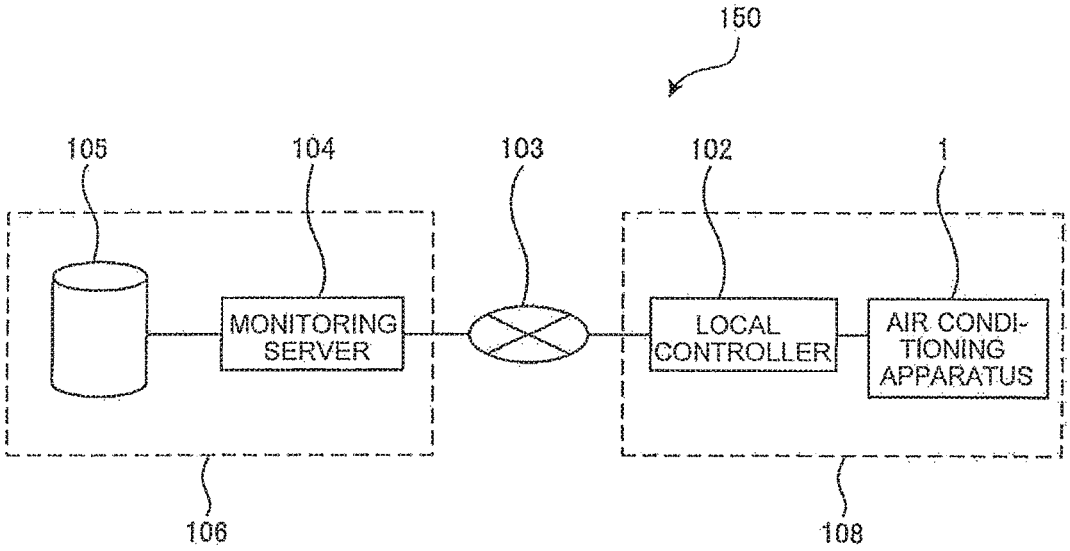
FIG. 23 is a system configuration diagram illustrating a configuration of a refrigeration cycle apparatus abnormality detecting system 150 according to Embodiment 4 of the present invention.

FIG. 23 is a system configuration diagram illustrating a configuration of a refrigeration cycle apparatus abnormality detecting system 150 according to Embodiment 4. As illustrated in FIG. 23, the abnormality detecting system 150 includes, as a client-side configuration, at least one air conditioning apparatus 1, and a local controller 102 (one example of a control unit) connected to the control unit 3 of the air conditioning apparatus 1. The control unit 3 and the local controller 102 constitute a client-side control unit in the abnormality detecting system 150.

The local controller 102 is installed at a property 108 together with the air conditioning apparatus 1. The local controller 102 is connected to one or multiple air conditioning apparatuses 1 directly, or through a dedicated adapter. The local controller 102 transmits and receives data to and from the one or multiple air conditioning apparatuses 1 and the control unit 3, and centrally manages the one or multiple air conditioning apparatuses 1. The local controller 102 includes a microcontroller equipped with components such as a CPU, ROM, RAM, and I/O ports. Also, the local controller 102 is connected to a monitoring server 104 described later via an Internet link 103 (one example of a communication network), and is configured to transmit and receive data to and from the monitoring server 104. For example, the local controller 102 periodically receives data from the control unit 3, and transmits the received data to the monitoring server 104.

The data transmitted from the local controller 102 to the monitoring server 104 includes information such as state data about the air conditioning apparatus 1, operation data about the air conditioning apparatus 1, and environmental conditions data. State data about the air conditioning apparatus 1 includes data such as the temperature, pressure, degree of superheat, degree of subcooling, and refrigerant quantity of refrigerant inside the refrigeration cycle, and the starting current of the compressor 21. Operation data about the air conditioning apparatus 1 includes data such as the number of running indoor units 4A and 4B in the air conditioning apparatus 1, and the operation mode of the air conditioning apparatus 1. Environmental conditions data includes data such as the outdoor temperature, the wind speed and wind direction of outdoor air, the amount of sunshine, and the amount of rain.

Also, the abnormality detecting system 150 includes, as a server-side configuration, a monitoring server 104 (one example of an abnormality detecting device) that detects an abnormality in an air conditioning apparatus 1 (refrigeration cycle) on the basis of data received from the local controller 102, and a data accumulating device 105 that accumulates data received from the local controller 102. The monitoring server 104 and the data accumulating device 105 are installed in a remote management center 106 distant from the property 108, for example. For the abnormality detecting device, a central controller may also be used instead of the monitoring server 104.

Figure 24:
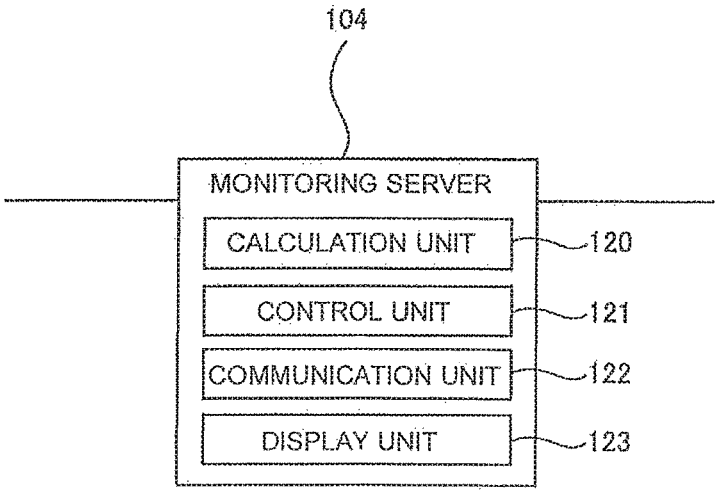
FIG. 24 is a block diagram illustrating a configuration of a monitoring server 104 in a refrigeration cycle apparatus abnormality detecting system 150 according to Embodiment 4 of the present invention.

FIG. 24 is a block diagram illustrating a configuration of the monitoring server 104. As illustrated in FIG. 24, the monitoring server 104 includes a calculation unit 120, a control unit 121, a communication unit 122, and a display unit 123. The calculation unit 120 performs calculations, such as computing the average value of data. The control unit 121 performs various controls, including controls related to abnormality detection, such as issuing data transmission commands to the local controller 102, setting an abnormality detecting mode, and performing abnormality determination. The communication unit 122 transmits and receives data to and from the local controller 102 via the Internet link 103, and in addition, transmits and receives data to and from the data accumulating device 105. The display unit 123 displays the determination result of an abnormality determination (whether or not an abnormality exists) for an air conditioning apparatus 1 performed by the monitoring server 104.

Figure 25:
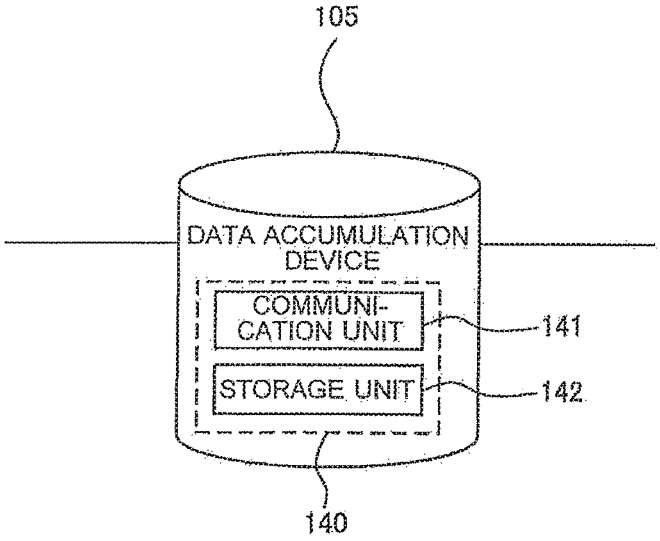
FIG. 25 is a block diagram illustrating a configuration of a data accumulation device 105 in a refrigeration cycle apparatus abnormality detecting system 150 according to Embodiment 4 of the present invention.

FIG. 25 is a block diagram illustrating a configuration of the data accumulating device 105. As illustrated in FIG. 25, the data accumulating device 105 includes a storage device 140. The storage device 140 is provided with a communication unit 141 that transmits and receives data to and from the monitoring server 104, and a storage unit 142 that stores received data. Upon receiving state data from the monitoring server 104, the data accumulating device 105 successively accumulates the received state data in the storage unit 142 in chronological order.

Note that in this example, the local controller 102, the monitoring server 104, and the data accumulating device 105 are configured separately from the air conditioning apparatus 1, but the functions of the local controller 102, the monitoring server 104, and the data accumulating device 105 may also be provided in the air conditioning apparatus 1 (for example, the control unit 3). Also, in this example, the data accumulating device 105 is connected to the Internet link 103 via the monitoring server 104, but the data accumulating device 105 may also be connected to the Internet link 103 directly.

In Embodiment 4, the monitoring server 104 uses information such as state data, operation data, and environmental conditions data accumulated chronologically in the data accumulating device 105 to sense an abnormality in the refrigeration cycle.

For example, the monitoring server 104 uses operation data and environmental conditions data accumulated in the data accumulating device 105 as well as information about the acquisition times of such data to classify the state data accumulated in the data accumulating device 105 into multiple groups in which the operation state of the air conditioning apparatus 1 and the environmental conditions are similar. Subsequently, the monitoring server 104 compares the most recent state data to past state data belonging to the same group (one example of a reference value), and on the basis of the comparison results (for example, the difference between the most recent state data and past state data, or the chronological trend of change in the state data), detects various abnormalities in the air conditioning apparatus 1.

According to Embodiment 4, advantageous effects similar to Embodiments 1 to 3 can be obtained, while in addition, abnormalities in a refrigeration cycle apparatus can be sensed at a remote management center 106. With this arrangement, it is possible to address a sudden abnormality in the refrigeration cycle before a situation such as equipment damage or a drop in capacity occurs.

As described above, a refrigeration cycle apparatus according to Embodiments 1 to 4 above is provided with a compressor 21, a condenser (for example, the outdoor heat exchanger 23 or the indoor heat exchangers 42A and 42B), a pressure-reducing device (for example, the expansion valves 41A and 41B), and an evaporator (for example, the outdoor heat exchanger 23 or the indoor heat exchangers 42A and 42B). The refrigeration cycle apparatus includes: a refrigeration cycle configured to circulate refrigerant; and a control unit 3 configured to control the refrigeration cycle. The control unit 3 causes the refrigeration cycle to operate (for example, step S2 in FIG. 17) when an operation condition is satisfied, the operation condition including elapse of a preset time after the refrigeration cycle stops (for example, a Yes determination in step S1 of FIG. 17). The control unit detects abnormality of the refrigeration cycle (for example, excess or insufficiency of the refrigerant, or abnormality of the compressor 21) based on a piece of state data indicating a state of the refrigeration cycle (for example, data such as the refrigerant temperature, pressure, degree of superheat, degree of subcooling, refrigerant quantity, and the starting current of the compressor 21) after the control unit causes the refrigeration cycle to operate (for example, steps S7 to S9 in FIG. 17).

Also, in a refrigeration cycle apparatus according to Embodiments 1 to 4 above, the control unit 3 causes the refrigeration cycle to operate and then stops the refrigeration cycle (for example, step S4 in FIG. 17), and detects abnormality of the refrigeration cycle based on a piece of state data indicating a state of the refrigeration cycle stopped.

Also, in a refrigeration cycle apparatus according to Embodiments 1 to 4 above, the refrigeration cycle is additionally provided with a liquid accumulation container 24 that accumulates liquid refrigerant. The state data includes the quantity of liquid refrigerant inside the liquid accumulation container 24. The abnormality of the refrigeration cycle includes excess or insufficiency of refrigerant quantity. The control unit 3 compares the quantity of liquid refrigerant inside the liquid accumulation container 24 to a reference value, and detects an excess or insufficiency of the refrigerant quantity based on the comparison result.

Also, in a refrigeration cycle apparatus according to Embodiments 1 to 4 above, the control unit 3 detects abnormality of the refrigeration cycle (for example, excess or insufficiency of the refrigerant) based on a piece of state data indicating a state of the refrigeration cycle in the operating state (for example, the refrigerant degree of superheat and degree of subcooling).

Also, in a refrigeration cycle apparatus according to Embodiments 1 to 4 above, the control unit 3 causes the refrigeration cycle to operate and stops the refrigeration cycle, and then causes the refrigeration cycle to operate again. The state data includes the starting current of the compressor 21 when the control unit 3 causes the refrigeration cycle to operate again. The abnormality of the refrigeration cycle includes abnormality of the compressor 21.

Also, in a refrigeration cycle apparatus according to Embodiments 1 to 4 above, the control unit 3 is configured to be able to execute an abnormality detecting mode that detects abnormality of the refrigeration cycle, and a normal operation mode that performs cooling operation or heating operation. The refrigeration cycle apparatus further includes a switch (for example, an operation switch of the input unit 3*g*) that switches between the abnormality detecting mode and the normal operation mode.

Also, a refrigeration cycle apparatus according to Embodiments 1 to 4 above further includes a display unit 3*i* configured to display a detected abnormality of the refrigeration cycle.

A refrigeration cycle apparatus abnormality detecting system 150 according to Embodiment 4 is provided with a compressor 21, a condenser (for example, the outdoor heat exchanger 23 or the indoor heat exchangers 42A and 42B), a pressure-reducing device (for example, the expansion valves 41A and 41B), and an evaporator (for example, the outdoor heat exchanger 23 or the indoor heat exchangers 42A and 42B). The refrigeration cycle apparatus abnormality detecting system 150 includes: a refrigeration cycle configured to circulate refrigerant; a control unit 3 configured to control the refrigeration cycle; and an abnormality detecting device (such as the monitoring server 104 or a central controller, for example) connected to the control unit 3 via a communication network (for example, the Internet link 103). The control unit 3 causes the refrigeration cycle to operate when an operation condition is satisfied, the operation condition including elapse of a preset time after the control unit 3 stops the refrigeration cycle. The control unit 3 transmits state data indicating a state of the refrigeration cycle after the control unit 3 causes the refrigeration cycle to operate to the abnormality detecting device. The abnormality detecting device detects abnormality of the refrigeration cycle based on the state data received from the control unit 3.

Also, the refrigeration cycle apparatus abnormality detecting system 150 according to Embodiment 4 further includes a data accumulating device 105 connected to the control unit 3 via a communication network. The abnormality detecting device accumulates state data received from the control unit 3 in the data accumulating device 105.

Other Embodiments

The present invention is not limited to Embodiments 1 to 4 described above, and various modifications are possible.

For example, in Embodiments 1 to 4 described above, the Internet link 103 is given as an example of a communication network, but a LAN or a WAN can also be used as the communication network.

Also, in Embodiments 1 to 4 described above, the air conditioning apparatus 1 is given as an example of a refrigeration cycle apparatus, but the present invention is also applicable to other refrigeration cycle apparatuses, such as water heaters, freezers, refrigerators, and vending machines.

The invention claimed is:

1. A refrigeration cycle apparatus comprising:

an expansion valve, and a liquid accumulation container configured to accumulate liquid refrigerant, connected via refrigerant pipes, that constitutes a refrigerant circuit forming a refrigeration cycle being configured to circulate refrigerant; and a controller configured to control the refrigeration cycle, the controller being configured to, while the refrigeration cycle apparatus is stopped from performing a normal operation mode:

control the expansion valve to have a fixed opening degree when the refrigeration cycle is stopped, cause the refrigeration cycle, which is stopped, to operate, then stop the refrigeration cycle, then detect abnormality of the refrigeration cycle based on state data indicating a state of the refrigeration cycle in the stopped state, the state data including a quantity of liquid refrigerant inside the liquid refrigerant container, the abnormality of the refrigeration cycle including excess or insufficiency of refrigerant quantity, perform a comparison of the quantity of the liquid refrigerant inside the liquid refrigerant container with a reference value, and detect the excess or insufficiency in refrigerant quantity based on a result of the comparison.

2. The refrigeration cycle apparatus of claim 1, wherein the controller is configured to execute an abnormality detecting mode to detect abnormality of the refrigeration cycle, and the normal operation mode to perform cooling operation or heating operation, and the refrigeration cycle apparatus further includes a switch configured to switch the abnormality detecting mode and the normal operation mode to and from each other.

3. The refrigeration cycle apparatus of claim 1, wherein the refrigeration cycle apparatus further includes a display configured to display a detected abnormality of the refrigeration cycle.

4. The refrigeration cycle apparatus of claim 1, wherein the fixed opening degree is larger than an opening degree of the expansion valve at a time when the refrigeration cycle is operating.

5. The refrigeration cycle apparatus of claim 1, wherein the controller is configured to cause the refrigeration cycle to operate when an operation condition is satisfied, the operation condition including elapse of a preset time after the refrigeration cycle stops.

6. The refrigeration cycle apparatus of claim 1, wherein the refrigerant circuit includes a compressor.

7. The refrigeration cycle apparatus of claim 6, wherein the controller is further configured to cause the compressor to operate at an upper limit of the rotational speed range immediately before stopping the refrigeration cycle after causing the refrigeration cycle to operate.

8. A refrigeration cycle apparatus comprising:

a compressor and configured to circulate refrigerant; and a controller configured to control a refrigeration cycle, wherein the controller is configured to cause the refrigeration cycle to operate, then stop the refrigeration cycle, and again cause the refrigeration cycle to operate, and detect abnormality of the refrigeration cycle based on state data indicating a state of the refrigeration cycle after the controller causes the refrigeration cycle to operate again, the state data includes a starting current of the compressor when the controller causes the refrigeration cycle to operate again, and the abnormality of the refrigeration cycle includes abnormality of the compressor.

9. The refrigeration cycle apparatus of claim 8, wherein the refrigeration cycle further include an expansion valve, wherein the controller is configured to control the expansion valve to have a fixed opening degree when the refrigeration cycle is stopped.

10. A refrigeration cycle apparatus abnormality detecting system comprising:

a refrigeration cycle apparatus of claim 8, and an abnormality detecting device connected to the controller via a communication network, wherein the controller is configured to transmit state data indicating a state of the refrigeration cycle stopped, to the abnormality detecting device, and the abnormality detecting device being configured to detect abnormality of the refrigeration cycle based on the state data received from the controller.

11. A refrigeration cycle apparatus abnormality detecting system comprising:

a refrigeration cycle apparatus of claim 1, and an abnormality detecting device connected to the controller via a communication network, wherein the controller is configured to transmit state data indicating a state of the refrigeration cycle stopped, to the abnormality detecting device, and the abnormality detecting device being configured to detect abnormality of the refrigeration cycle based on the state data received from the controller.

12. The refrigeration cycle apparatus abnormality detecting system of claim 11, wherein the refrigeration cycle apparatus abnormality detecting system further includes a data accumulating storage connected to the controller via a communication network, and the abnormality detecting device accumulates the state data received from the controller in the data accumulating storage.

13. The refrigeration cycle apparatus abnormality detecting system of claim 11, wherein the controller is configured to cause the refrigeration cycle to operate when an operation condition is satisfied, the operation condition including elapse of a preset time after the refrigeration cycle stops.

* * * * *